US007908749B2

(12) United States Patent
Sasaki

(10) Patent No.: US 7,908,749 B2
(45) Date of Patent: Mar. 22, 2011

(54) SHARPENER FOR STICK-SHAPED COSMETIC MATERIAL

(75) Inventor: Arata Sasaki, Tokyo (JP)

(73) Assignee: Tokiwa Corporation, Gifu (JP)

( * ) Notice: Subject to any disclaimer, the term of this patent is extended or adjusted under 35 U.S.C. 154(b) by 663 days.

(21) Appl. No.: 11/822,896

(22) Filed: Jul. 11, 2007

(65) Prior Publication Data

US 2008/0016706 A1 Jan. 24, 2008

(30) Foreign Application Priority Data

Jul. 19, 2006 (JP) ..... 2006-197039

(51) Int. Cl.
*B43L 23/00* (2006.01)

(52) U.S. Cl. ..... 30/451; 30/454; 30/457

(58) Field of Classification Search ..... 30/451–462
See application file for complete search history.

(56) References Cited

U.S. PATENT DOCUMENTS

| | | | | | |
|---|---|---|---|---|---|
| 123,462 | A | * | 2/1872 | DeZeng | 30/455 |
| 225,732 | A | * | 3/1880 | Suter | 30/452 |
| 679,136 | A | * | 7/1901 | Anderson | 30/455 |
| 957,733 | A | * | 5/1910 | Brantz | 30/452 |
| 1,172,066 | A | * | 2/1916 | Spanovic | 30/283 |
| 1,603,540 | A | * | 10/1926 | Holtzman | 30/452 |
| 2,128,115 | A | * | 8/1938 | Bien | 30/462 |
| 2,496,495 | A | * | 2/1950 | Riker | 30/455 |

FOREIGN PATENT DOCUMENTS

JP 2006-035819 9/2006

* cited by examiner

*Primary Examiner* — Boyer D Ashley
*Assistant Examiner* — Omar Flores-Sánchez
(74) *Attorney, Agent, or Firm* — Bacon & Thomas, PLLC

(57) ABSTRACT

A sharpener for a stick-shaped cosmetic material comprises guide rails (3*h*) disposed in a longitudinal direction over a sliding surface (3*d*), and a continuous surface (3*g*) at an upper side of both surfaces. The sliding surface (3*d*) is formed in an acute inner angle shape as seen in the longitudinal direction for sliding a leading end portion of the cosmetic material thereon. The continuous surface (3*g*) constitutes an upper side of a blade with a cutting edge (3*e*) facing to a rear end edge of the sliding surface (3*d*) at a position slightly higher than the sliding surface (3*d*). A leading end portion of a stick-shaped cosmetic material feeding container (100) is guided by the guide rails (3*h*), thereby preventing the container (100) from being shaken.

2 Claims, 21 Drawing Sheets

SHARPENER FOR STICK-SHAPED COSMETIC MATERIAL

BACKGROUND OF THE INVENTION

1. Field of the Invention

The present invention relates to a sharpener for a stick-shaped cosmetic material for sharpening a leading end portion of the stick-shaped cosmetic material in a predetermined acute shape.

2. Description of Conventional Art

Conventionally, as a sharpener for a stick-shaped cosmetic material for sharpening the stick-shaped cosmetic material, for example, an eyebrow, a lip liner or the like, there has been known a structure described in Japanese Unexamined Patent Publication No. 2006-35819. The sharpening for the stick-shaped cosmetic material in Japanese Unexamined Patent Publication No. 2006-35819 comprises a V-shaped sliding portion having a sliding surface for achieving a sliding motion in a longitudinal direction by applying a leading end portion of the stick-shaped cosmetic material thereto at an upper side, the sliding surface being formed to have an acute inner angle as seen in the longitudinal direction, and a blade being provided with a cutting edge headed for a front side so as to face to a rear end edge of the sliding surface at a position which is slightly higher than the sliding surface, having a V-shaped continuous surface allowing a continuous sliding motion from the sliding motion executed by applying to the sliding surface at an upper side, and sharpening the leading end portion of the stick-shaped cosmetic material in a double-edged shape through the sliding motion executed from the sliding surface to the continuous surface.

SUMMARY OF THE INVENTION

Problem to be Solved by the Invention

However, in the sharpener for the stick-shaped cosmetic material described in the publication mentioned above, a hand shake is generated at a time of applying the leading end portion of the stick-shaped cosmetic material to the sliding surface and the continuous surface of the sharpener for the stick-shaped cosmetic material so as to slide in the longitudinal direction, and there is a problem that the desired double-edged shape can not be stably obtained. Further, it is necessary to hold the stick-shaped cosmetic material by a hand, and there is a problem that the hand is soiled.

Accordingly, an object of the present invention is to provide a sharpener for a stick-shaped cosmetic material which can stably obtain a desired acute shape such as a double-edged shape without soiling a hand.

Means for Solving the Problem

In accordance with the present invention, there is provided a sharpener for a stick-shaped cosmetic material comprising:

an acute angle shaped sliding portion having a sliding surface for executing a sliding motion in a longitudinal direction by applying a leading end portion of the stick-shaped cosmetic material at an upper side, the sliding surface being formed to have an acute inner angle as seen in the longitudinal direction; and a blade being provided with a cutting edge headed for a front side so as to face to a rear end edge of the sliding surface at a position which is slightly higher than the sliding surface, having an acute angle shaped continuous surface allowing a continuous sliding motion from the sliding motion executed by applying to the sliding surface at an upper side, and sharpening the leading end portion of the stick-shaped cosmetic material in an acute angle shape through the sliding motion executed on the sliding surface to the continuous surface, wherein guide rails extending in the longitudinal direction over the sliding surface and the continuous surface are provided at an upper side than the sliding surface and the continuous surface, and the guide rails guide the leading end portion of a stick-shaped cosmetic material feeding container in a direction of sharpening the leading end portion of the stick-shaped cosmetic material fed out from the stick-shaped cosmetic material feeding container into an acute angle shape.

In accordance with the sharpener for the stick-shaped cosmetic material mentioned above, since the leading end portion of the stick-shaped cosmetic material feeding container is guided in the direction of sharpening the leading end portion of the stick-shaped cosmetic material fed out from the stick-shaped cosmetic material feeding container into the acute angle shape, by the guide rails provided so as to extend in the longitudinal direction over the sliding surface and the continuous surface at the upper side than the sliding surface, which is formed to have the acute inner angle as seen from the longitudinal direction and provided for executing the sliding motion in the longitudinal direction by applying the leading end portion of the stick-shaped cosmetic material, and the continuous surface constructing the upper side than the cutting edge facing to the rear end edge of the sliding surface at the position which is slightly higher than the sliding surface and being headed for the front side, being formed in the acute angle shape and allowing the sliding motion continuous from the sliding motion executed by applying the leading end portion of the stick-shaped cosmetic material to the sliding surface, it is possible to prevent the leading end portion of the stick-shaped cosmetic material feeding container from being shaken at a time of sharpening. Accordingly, it is possible to stably obtain the desired acute shape without soiling a hand.

In this case, it is preferable that the guide rails are constituted by a pair of step portions which are respectively provided at the upper side than the sliding surface and the continuous surface so as to oppose in such a manner as to sandwich the sliding surface and the continuous surface, each of the guide rails having a bottom portion regulating a shake in a vertical direction at a time when the leading end portion of the stick-shaped cosmetic material feeding container slides, and a side portion regulating a shake in a horizontal direction. In the case of employing the structure mentioned above, the shake in the vertical direction at the sliding time of the leading end portion of the stick-shaped cosmetic material feeding container is regulated by the bottom portions of a pair of step portions corresponding to the guide rails, and the shake in the horizontal direction at the sliding time of the leading end portion of the stick-shaped cosmetic material feeding container is regulated by the side portions of a pair of step portions. Accordingly, it is possible to securely prevent the shake of the leading end portion of the stick-shaped cosmetic material feeding container at a time of sharpening.

Effect of the Invention

As mentioned above, in accordance with the present invention, it is possible to provide the sharpener for the stick-shaped cosmetic material in which the desired acute shape can be stably obtained without soiling a hand.

DETAILED DESCRIPTION OF PREFERRED EMBODIMENT

Figure 1:
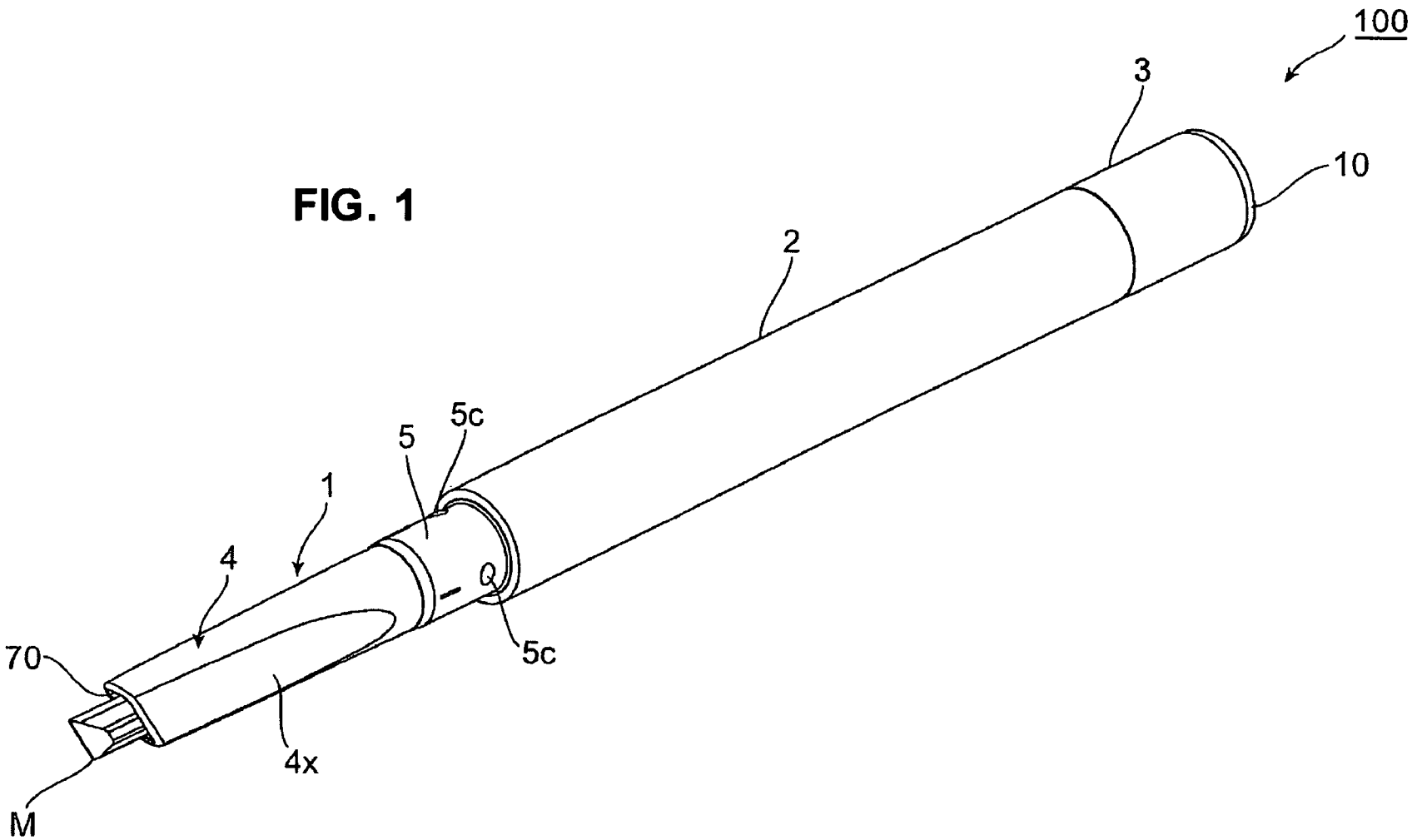
FIG. 1 is a perspective view showing an outer appearance of a stick-shaped cosmetic material feeding container provided with a sharpener for a stick-shaped cosmetic material in accordance with an embodiment of the present invention.

A description will be given below of a preferred embodiment of a sharpener for a stick-shaped cosmetic material in accordance with the present invention with reference to FIGS. 1 to 21. In this case, in each of the drawings, the same reference numerals are attached to the same elements and an overlapping description will be omitted.

Figure 2:
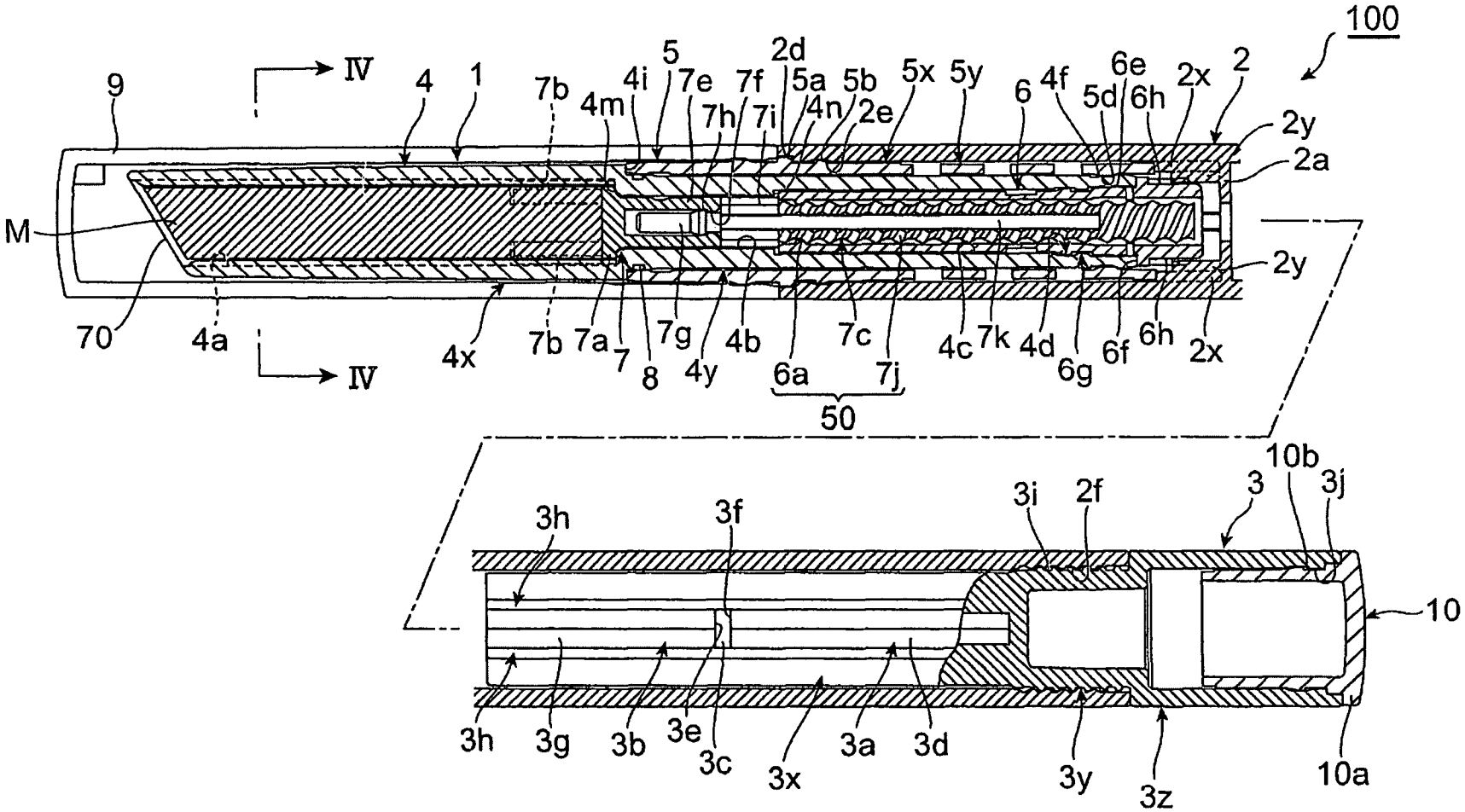
FIG. 2 is a vertical sectional view of the stick-shaped cosmetic material feeding container shown in FIG. 1.
Figure 3:
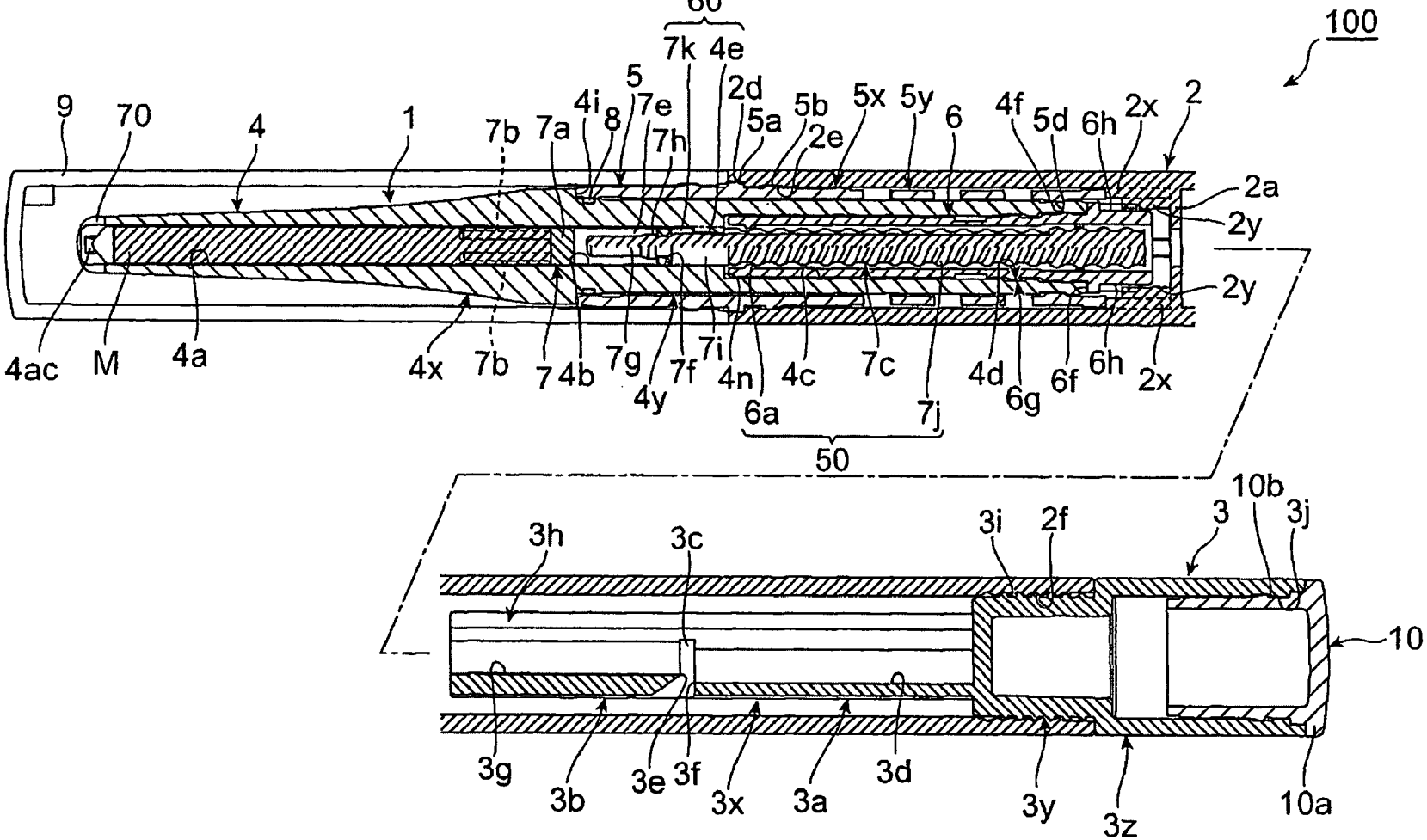
FIG. 3 is an orthogonal vertical sectional view of the stick-shaped cosmetic material feeding container shown in FIG. 2.
Figure 4:
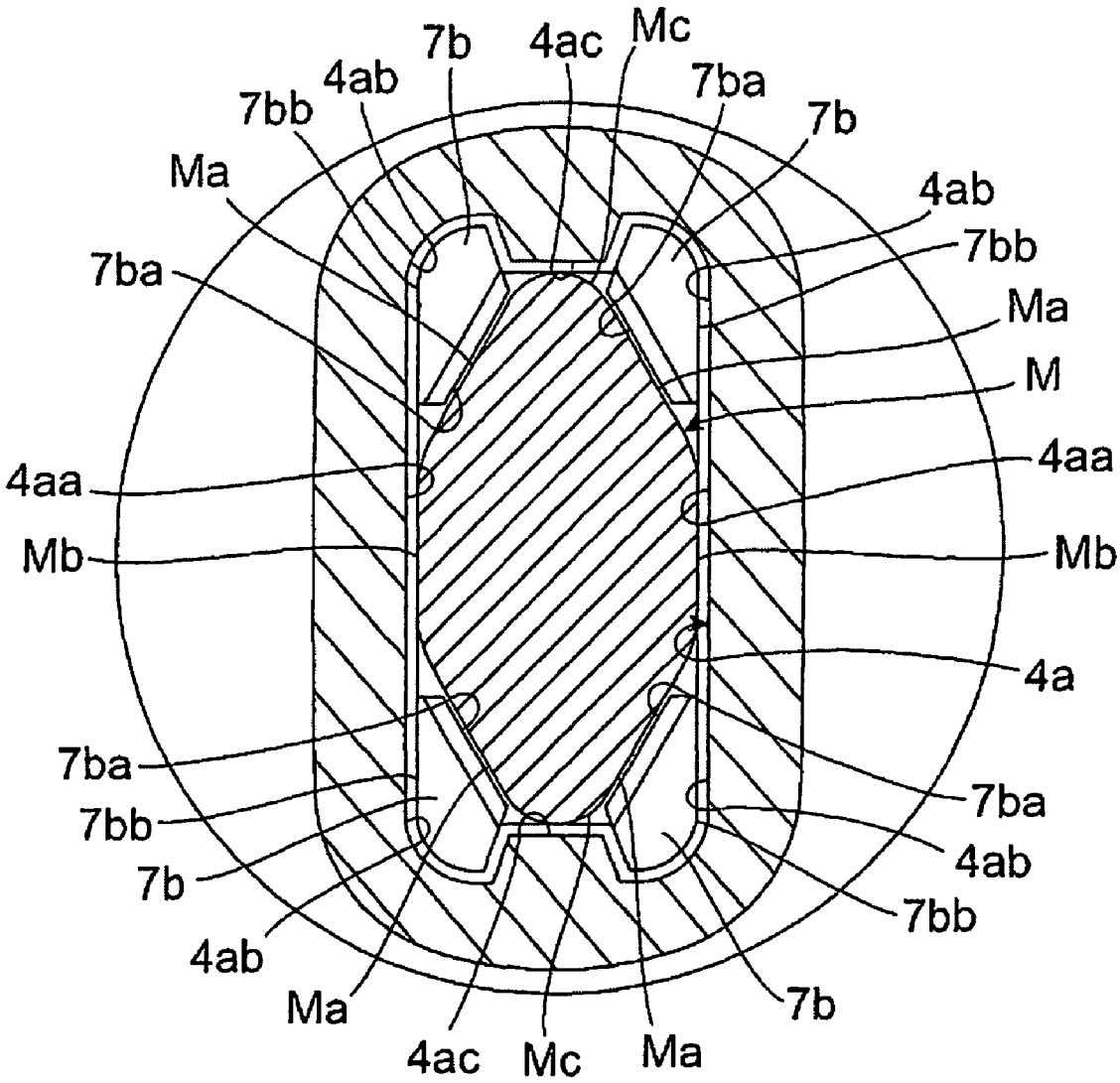
FIG. 4 is a view as seen from a section shown by arrows IV-IV in FIG. 2.
Figure 5:
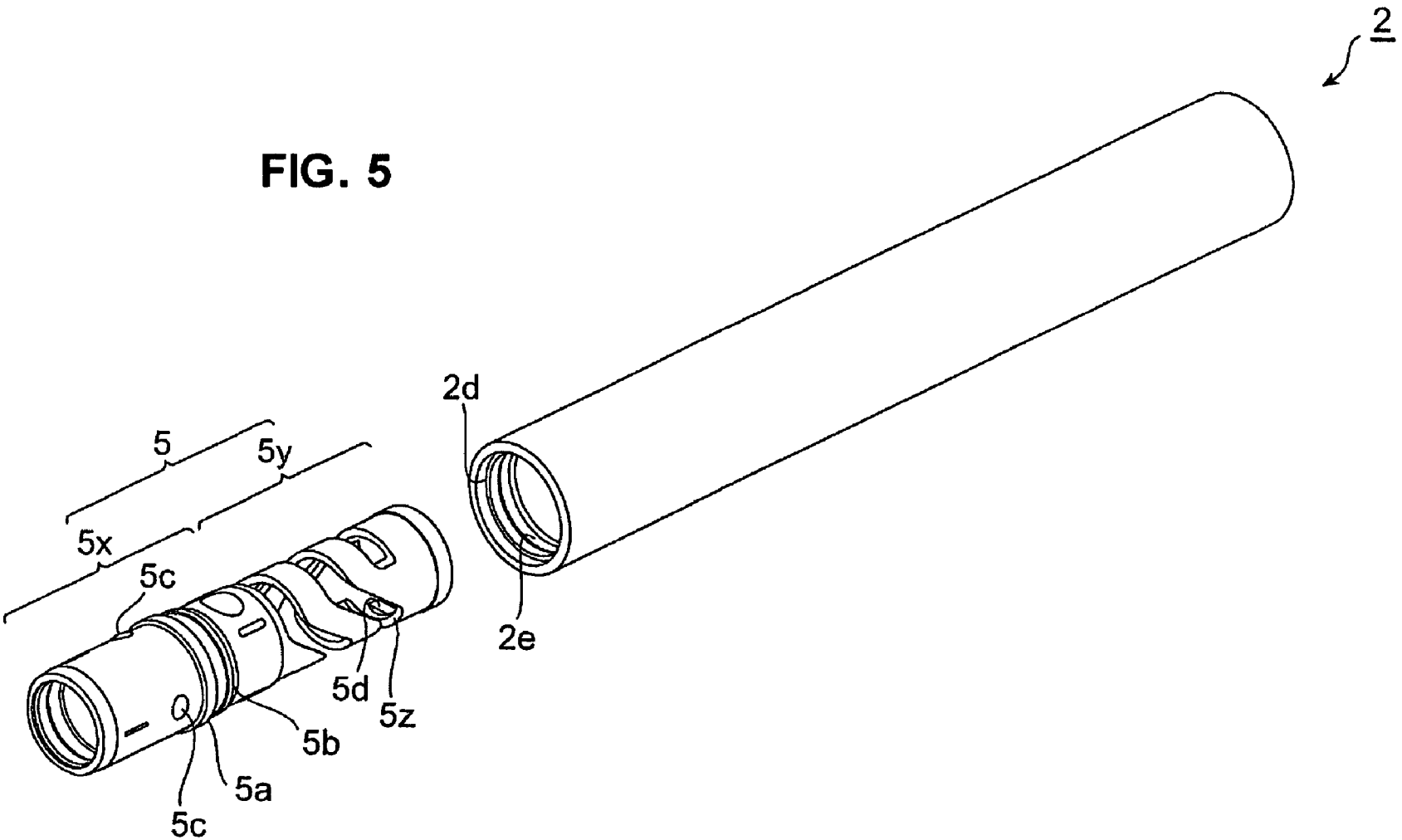
FIG. 5 is an exploded perspective view showing a cartridge accommodating container and a middle piece in FIGS. 2 and 3.
Figure 6:
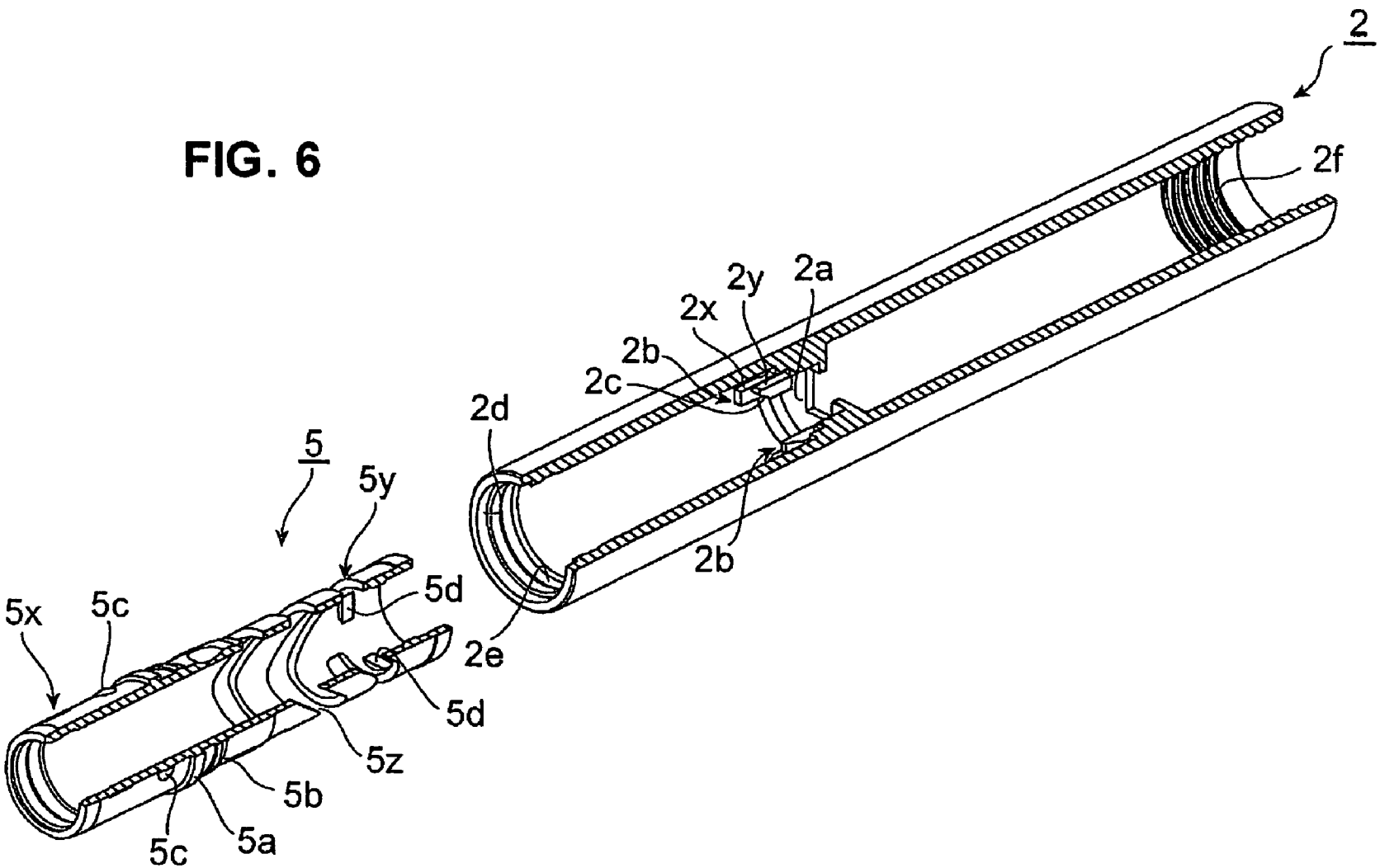
FIG. 6 is a cut exploded perspective view of the cartridge accommodating container and the middle piece shown in FIG. 5.
Figure 7:
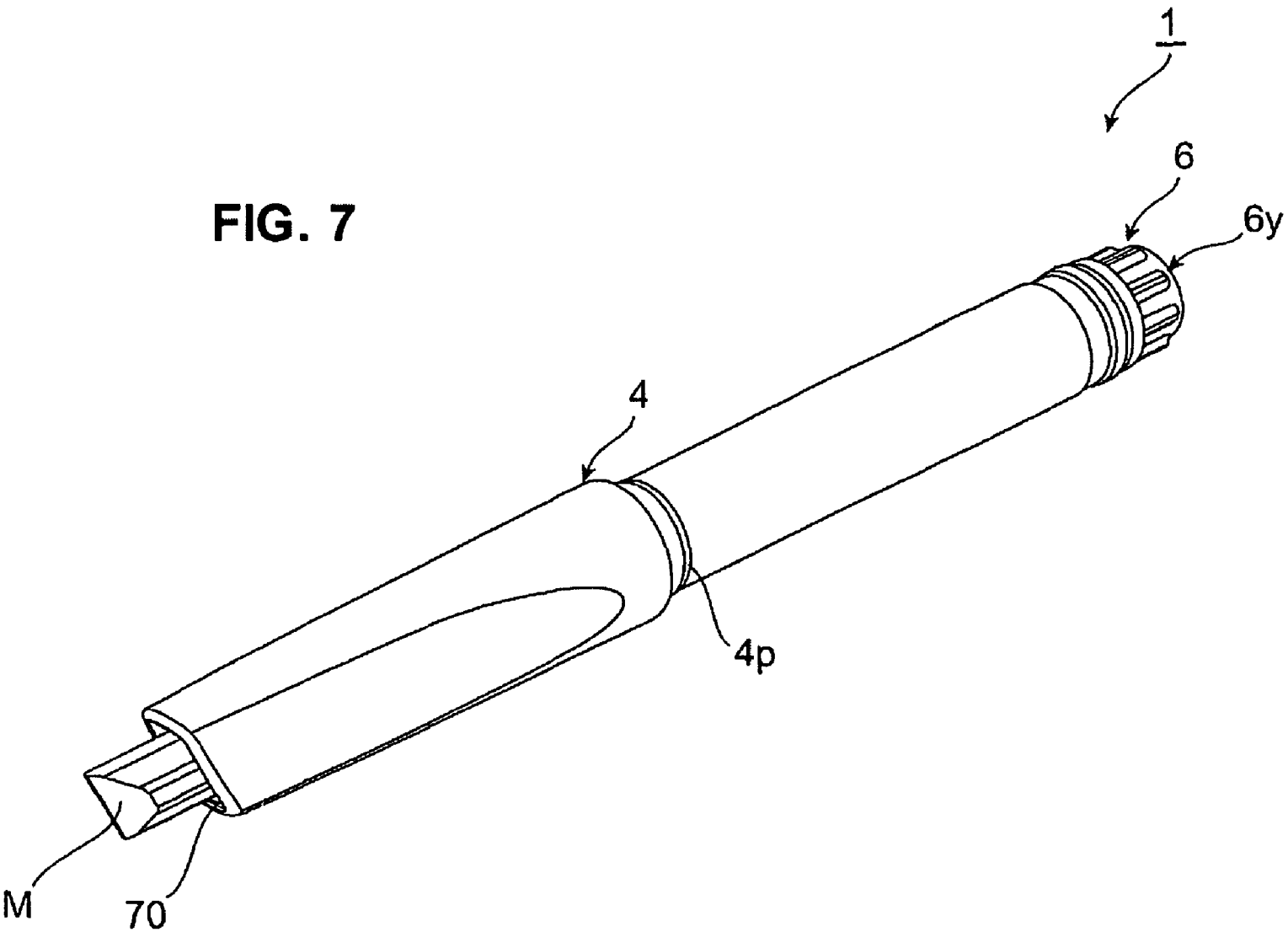
FIG. 7 is a perspective view showing a stick-shaped cosmetic material cartridge in FIGS. 2 and 3.
Figure 8:
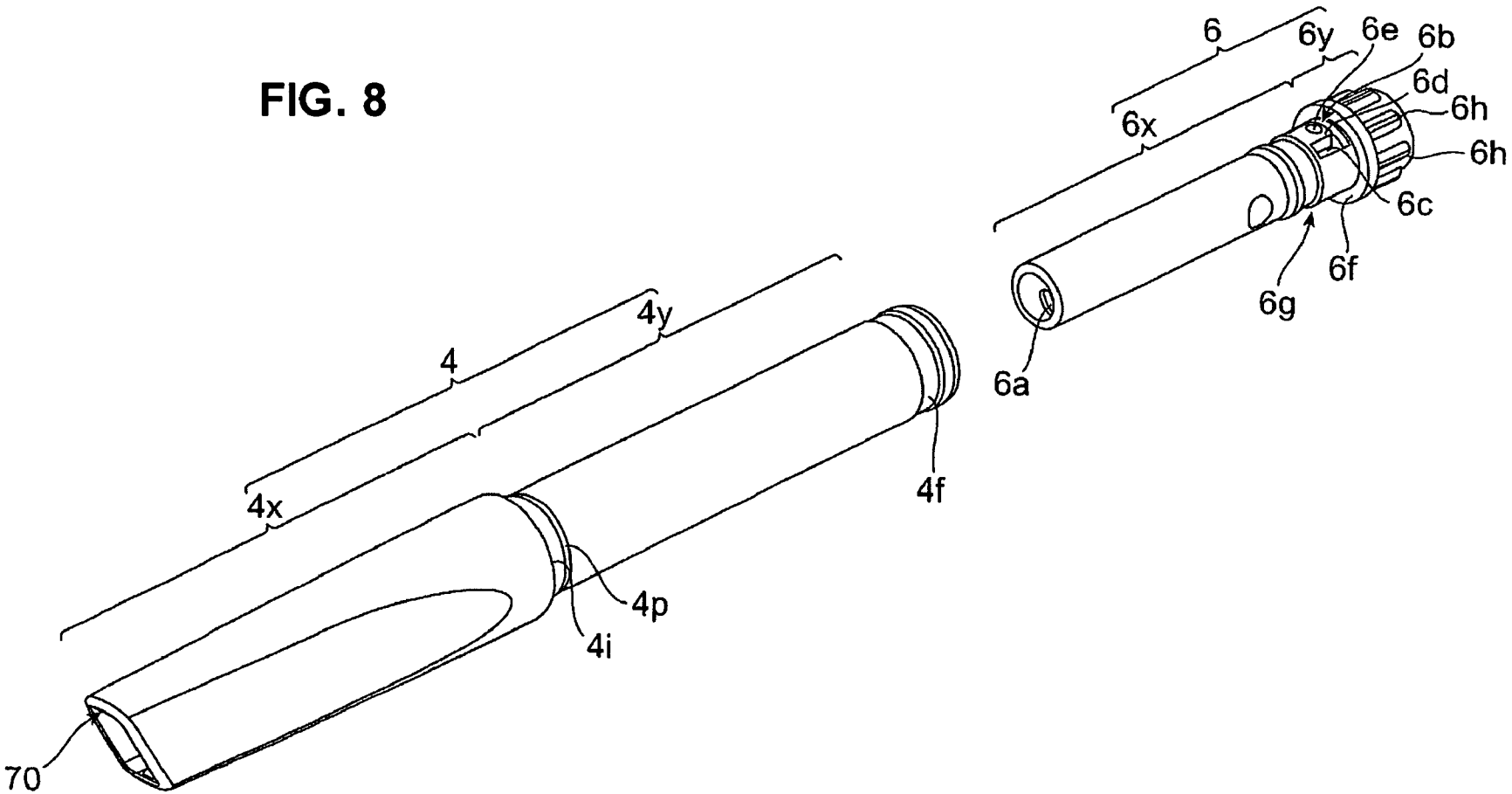
FIG. 8 is an exploded perspective view of a cartridge tube and a thread tube in FIG. 7.
Figure 9:
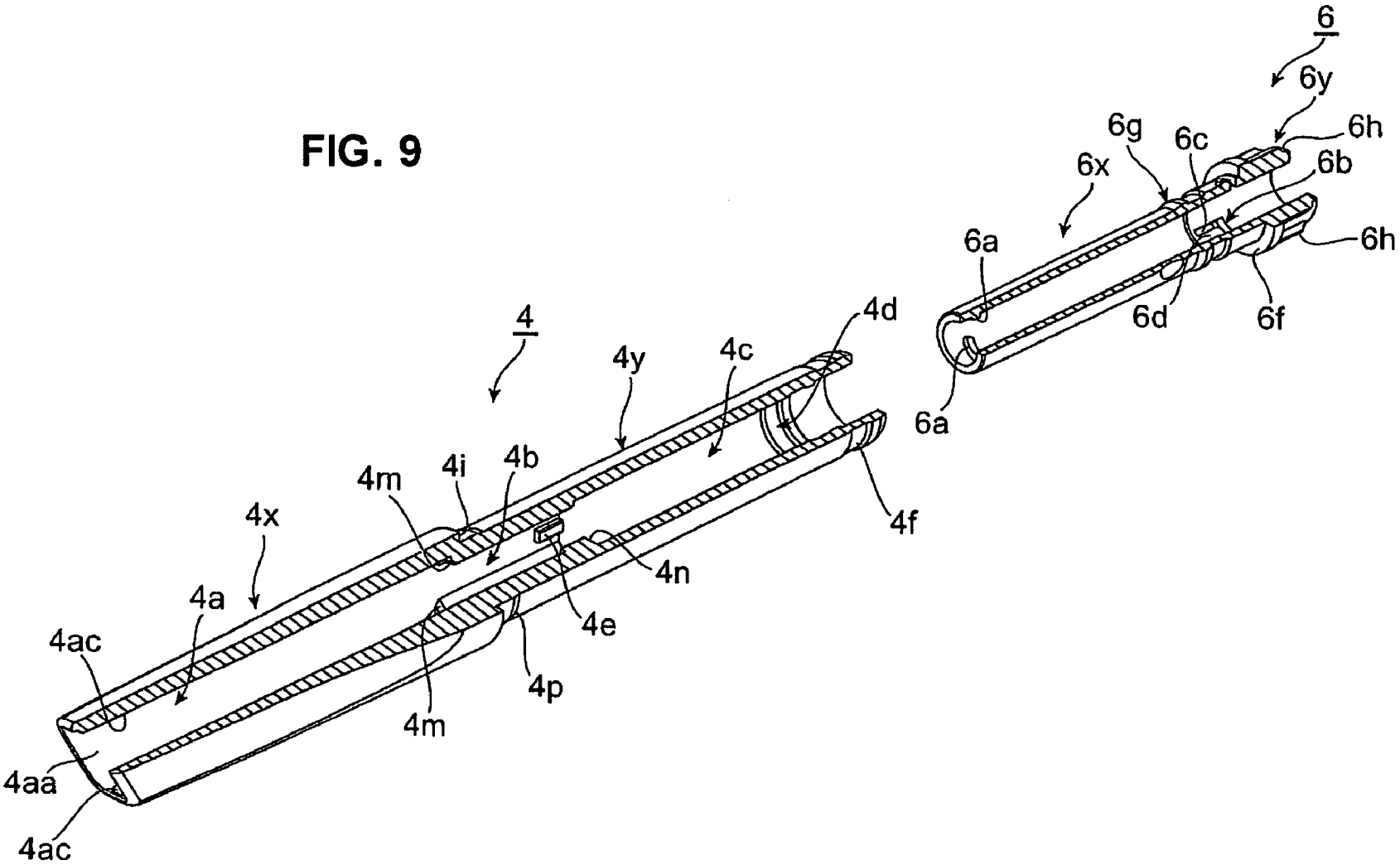
FIG. 9 is a cut exploded perspective view of the cartridge tube and the thread tube shown in FIG. 8.
Figure 10:
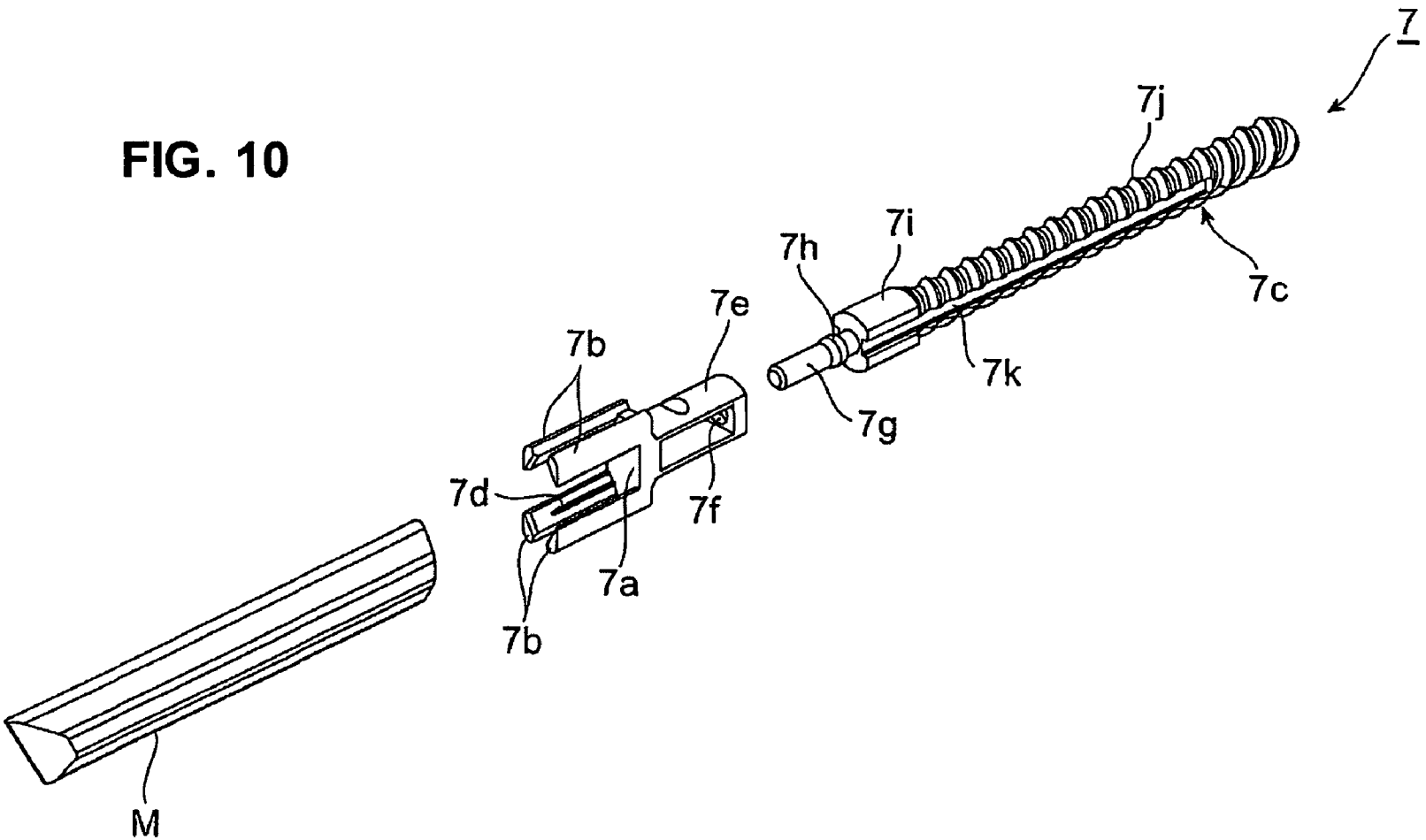
FIG. 10 is an exploded perspective view showing a stick-shaped cosmetic material support body and the stick-shaped cosmetic material in FIGS. 2 and 3.
Figure 11:
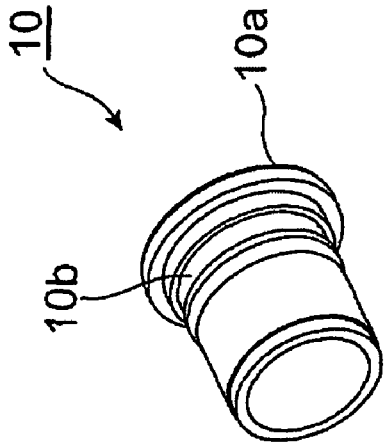
FIG. 11 is an exploded perspective view showing a sharpener for the stick-shaped cosmetic material and a tail valve in FIGS. 2 and 3.
Figure 11:
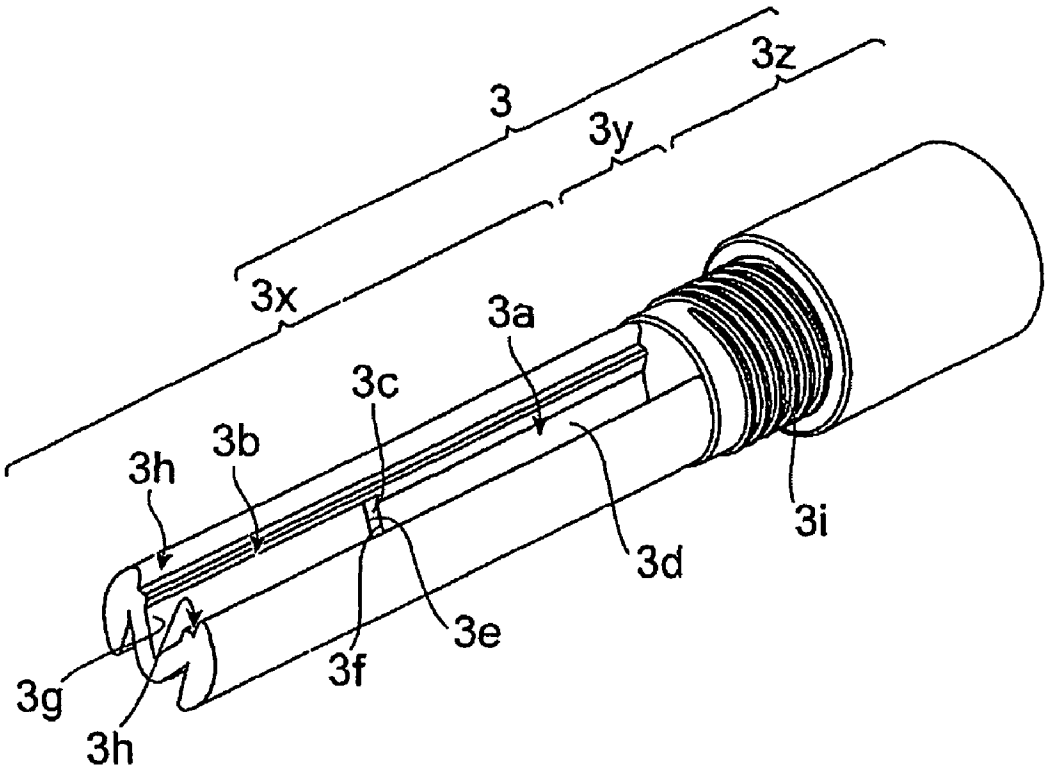
Figure 12:
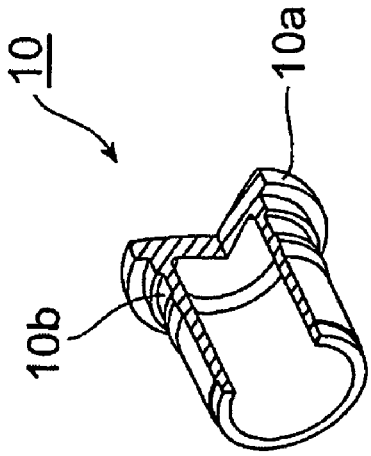
FIG. 12 is a cut exploded perspective view of the sharpener for the stick-shaped cosmetic material and the tail valve shown in FIG. 11.
Figure 12:
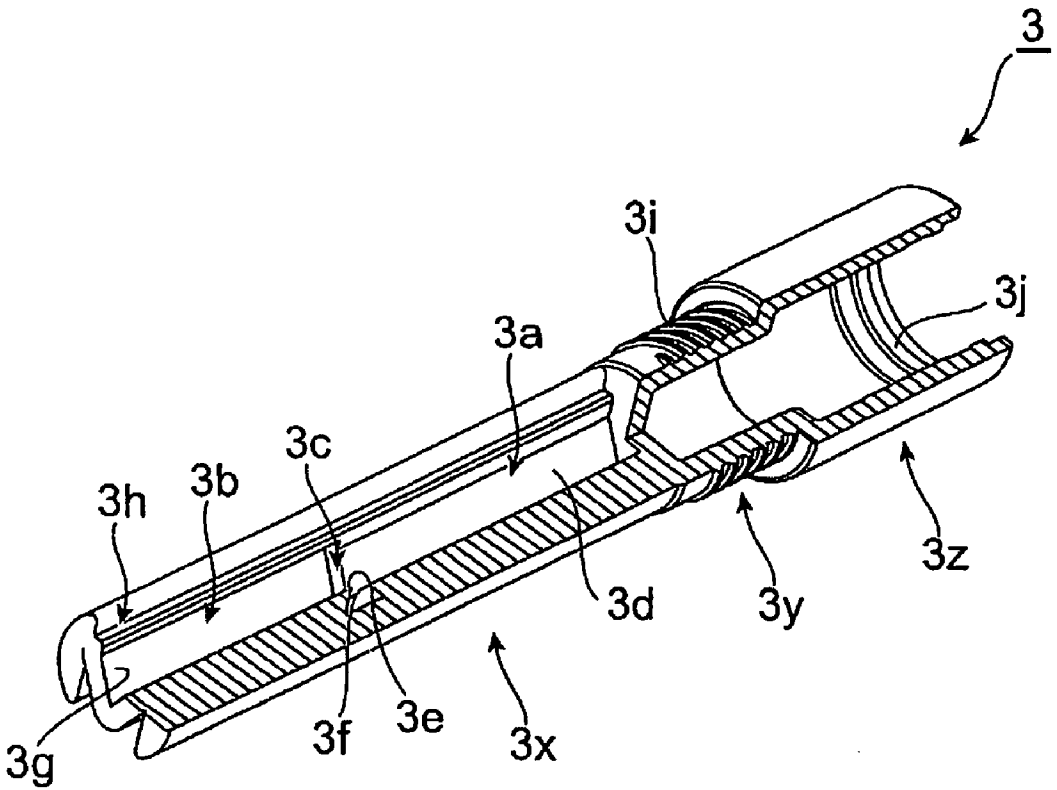
Figure 13:
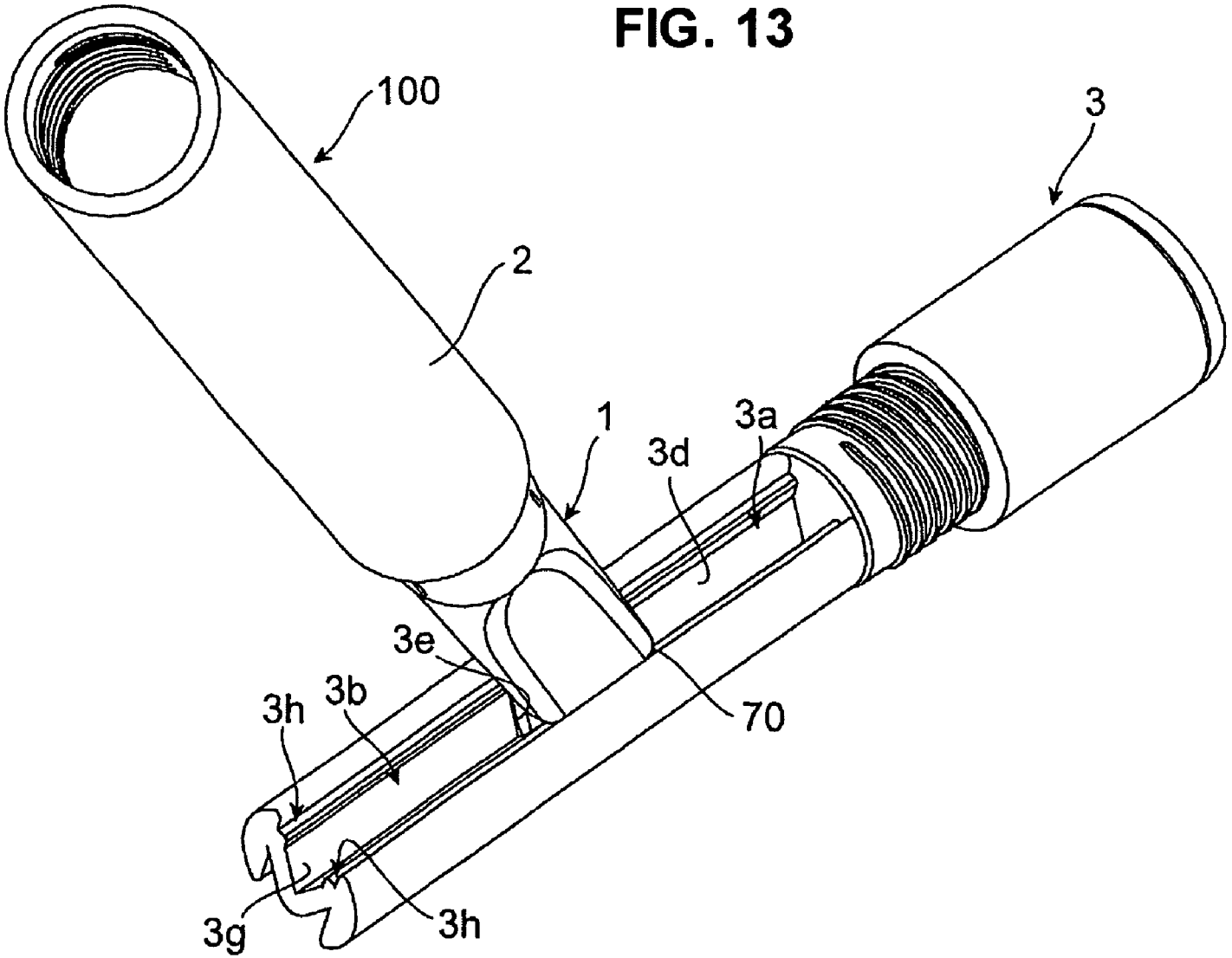
FIG. 13 is a perspective view showing a state at a time of sharpening a leading end portion of the stick-shaped cosmetic material by using the sharpener for the stick-shaped cosmetic material.
Figure 14:
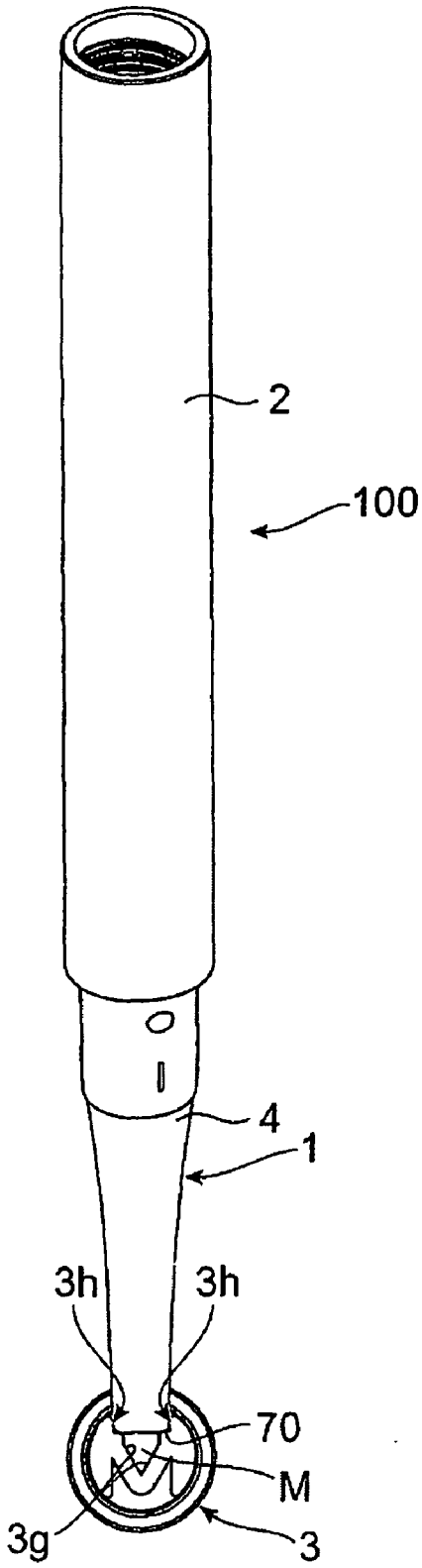
FIG. 14 is a front view showing the state at a time of sharpening the leading end portion of the stick-shaped cosmetic material by using the sharpener for the stick-shaped cosmetic material.
Figure 15:
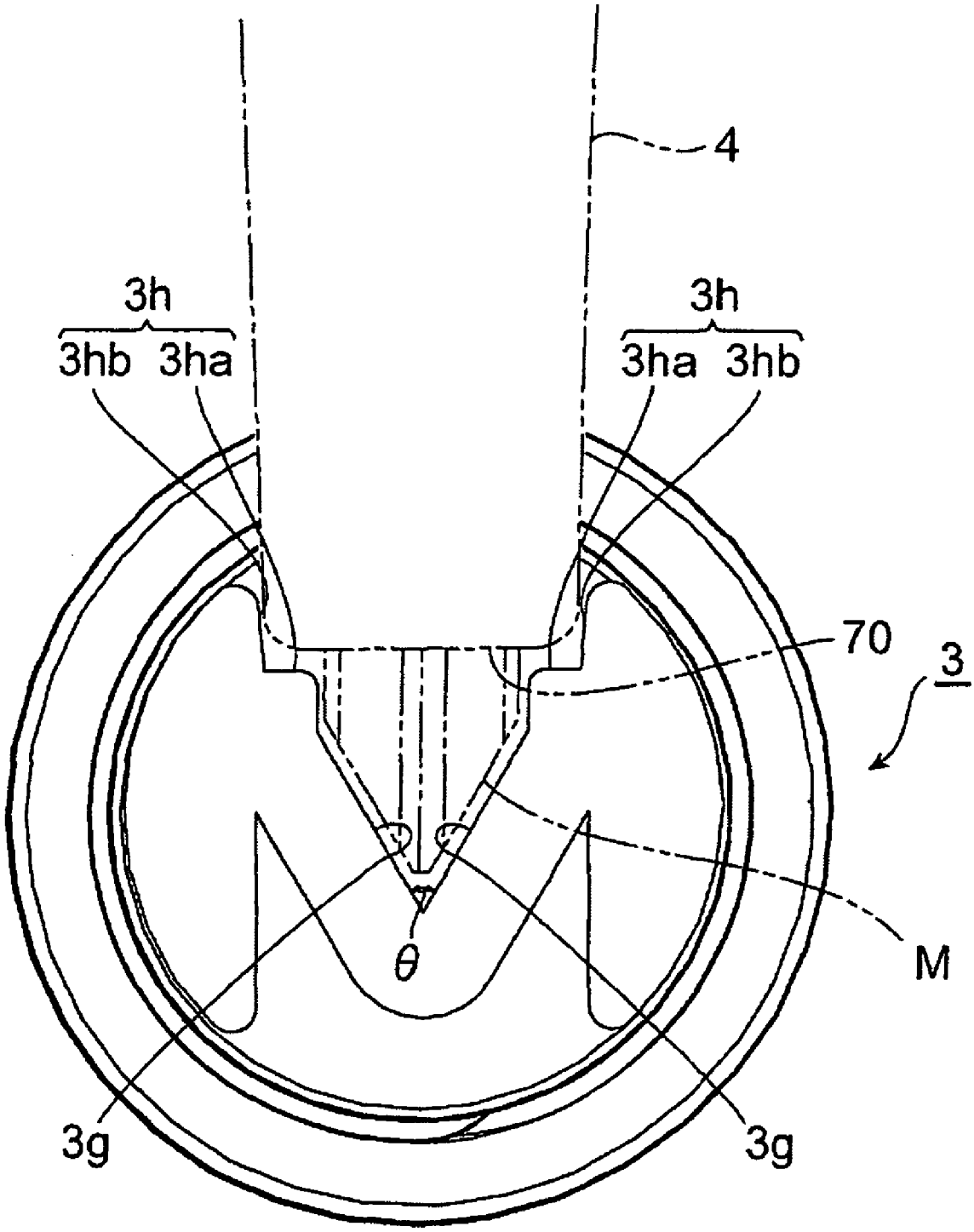
FIG. 15 is a front view showing main portions of FIGS. 13 and 14 in an enlarged manner.

FIG. 1 is a perspective view showing an outer appearance of a stick-shaped cosmetic material feeding container provided with a sharpener for a stick-shaped cosmetic material, FIGS. 2 to 4 are cross sectional views of the stick-shaped cosmetic material feeding container, FIGS. 5 and 6 are exploded perspective views showing a cartridge accommodating container and a middle piece, FIG. 7 is a perspective view showing a stick-shaped cosmetic material cartridge, FIGS. 8 and 9 are exploded perspective views showing a cartridge tube and a thread tube, FIG. 10 is an exploded perspective view showing a stick-shaped cosmetic material support body and the stick-shaped cosmetic material, FIGS. 11 and 12 are exploded perspective views showing the sharpener for the stick-shaped cosmetic material and a tail valve, and FIGS. 13 to 15 are views showing a state at a time of sharpening a leading end portion of the stick-shaped cosmetic material by using the sharpener for the stick-shaped cosmetic material.

The stick-shaped cosmetic material used here is constituted by various solid stick-shaped cosmetic materials, for example, an eyeliner, an eyebrow, a lip liner, a concealer and the like, and is constituted by a stick-shaped cosmetic material M structured such that a cross sectional shape has a long diameter and a short diameter, and respective inclined surfaces Ma are provided between the long diameter and the short diameter, as shown in FIG. 4. In this case, the stick-shaped cosmetic material M is formed in a shape obtained by cutting corner portions of a rectangular cross sectional shape, and is structured such that an outer peripheral surfaces Mb at a short diameter side are formed as a parallel and flat surface, an outer peripheral surfaces Mc at a long diameter side are formed as a circular arc surfaces having a small radius, and each of the inclined surfaces Ma are positioned between the short diameter side outer peripheral surface Mb and the long diameter side outer peripheral surface Mc. Further, in this case, the leading end of the stick-shaped cosmetic material M is formed in an inclined shape with respect to a plane which is orthogonal to an axis as seen in a vertical direction to the paper surface in FIG. 2, as shown in FIG. 2.

As shown in FIG. 1, a stick-shaped cosmetic material feeding container 100 is structured such that a whole shape is formed in a round rod shape (a stick shape) such as a writing instrument so as to have a good looking appearance. As shown in FIGS. 1 to 3, the stick-shaped cosmetic material feeding container 100 is detachably provided with a stick-shaped cosmetic material cartridge 1 for accommodating the stick-shaped cosmetic material M mentioned above at one end side (a left side in the drawing) of the cartridge accommodating container 2, and is detachably provided with a stick-shaped material sharpener 3 at the other end side of the cartridge accommodating container 2, whereby in the case that a cartridge tube 4 and the cartridge accommodating container 2 constituting an outer shape of the stick-shaped cosmetic material cartridge 1 are relatively rotated by a user, the stick-shaped cosmetic material M is taken out and in from a leading end of the cartridge tube 4. In this case, the stick-shaped cosmetic material cartridge 1 can be covered by a detachable cap 9 as occasion demands, as shown in FIGS. 2 and 3.

The cartridge accommodating container 2 is structured in a cylindrical shape in which both ends are open, as shown in FIGS. 5 and 6. The cartridge accommodating container 2 is structured, as shown in FIG. 6, such that an approximately middle position in an axial direction within a tube is comparted by a middle partition 2*a*, a space accommodating a rear half portion of the stick-shaped cosmetic material cartridge 1 via a middle piece 5 is defined within a tube at the left side in the drawing from the middle partition 2*a*, and a space accommodating a rear half portion of the stick-shaped cosmetic material sharpener 3 is defined within a right side tube.

A stepped rib 2*b* extending toward an opening at a leading end is provided at each of four uniformly arranged positions of a peripheral edge, at the stick-shaped cosmetic material cartridge 1 side (at a left side of the drawing) from the middle partition 2*a* comparting both the spaces. The rib 2*b* is provided with a lower stage rib 2*x* for contacting to a rear end surface of the middle piece 5, and an upper stage rib 2*y* for engaging with a thread tube 6 mentioned below of the stick-shaped cosmetic material cartridge 1 in a rotational direction. A leading end of the upper stage rib 2*y* is formed in a shape recessed to the middle compartment 2*a* side than the lower stage rib 2*x*, and the leading end surface in the recessed shape is formed as an inclined surface 2*c* which inclines at 60 degree with respect to a peripheral direction.

Further, the cartridge accommodating container 2 is formed somewhat larger than an inner diameter inside the tube, at an opening end at the stick-shaped cosmetic material cartridge 1 side, is provided with a step hole 2*d* for accommodating an annular collar portion 5*a* mentioned below of the middle piece 5, and is provided with an annular groove portion 2*e* for engaging the middle piece 5 in an axial direction, at a position closer to a rear side in the axial direction than the step hole 2*d*. Further, the cartridge accommodating container 2 is provided with a female thread 2*f* for installing the stick-shaped cosmetic material sharpener 3, on an inner peripheral surface at an inner side than the opening end at the stick-shaped cosmetic material sharpener 3 side (at a right side in the drawing).

The middle piece 5 is formed as an injection molded product by a resin, and is formed in an approximately cylindrical shape provided with a spring portion 5*y* at a rear half portion, and a main body portion 5*x* at a front side than the spring portion 5*y*, as shown in FIGS. 5 and 6.

The main body portion 5*x* is provided with an annular collar portion 5*a*, in which an outer peripheral surface in the middle in the axial direction is enlarged in a radial direction, as a structure which is accommodated in the step hole 2*d* of the cartridge accommodating container 2, and is provided with an annular protruding portion 5*b* as a structure engaging with the annular groove 2*e* of the cartridge accommodating container 2 in the axial direction, on an outer peripheral surface at a rear side than the annular collar portion 5*a*. Further, a plurality of protruding portions (so-called dowels) for engaging a cap 9 shown in FIG. 2 detachably in an axial direction are provided along a peripheral direction, on an outer peripheral surface at a front side than the annular collar portion 5*a* of the main body portion 5*x*.

The spring portion 5*y* is constituted by a so-called resin spring which is integrally provided at a rear side of the main body portion 5*x*, and is provided with a notch hole 5*z* formed by notching a slit in a spiral shape so as to freely expanding and contracting in the axial direction. The spring portion 5*y* can vary its strength on the basis of a shape of the notch hole 5*z*. Further, a plurality of protruding portions 5*d* for detachably engaging the cartridge tube 4 in the axial direction are provided along the peripheral direction, on the inner peripheral surface of the rear end portion of the spring portion 5*y*.

Further, the middle piece 5 provided with the main body portion 5*x* and the spring portion 5*y* is structured such that the spring portion 5*y* is made freely expand and contract in the axial direction by the notch hole 5*z* so as to have a shock absorbing property, and the notch hole 5*z* is compressed to the leading end side and the rear portion side including the notch hole 5*z* is moved to the leading end side, in the case that external force toward the leading end side is applied to the rear end side of the spring portion 5*y*.

The middle piece 5 is structured, as shown in FIGS. 2 and 3, such that the rear side portion than the annular collar portion 5*a* is inserted into to the cartridge accommodating container 2, and the annular collar portion 5*a* is contacted to the step hole 2*d* of the cartridge accommodating container 2 so as to be accommodated. Further, the rear end surface of the spring portion 5*y* is brought into contact with the lower stage lip 2*x* of the cartridge accommodating container 2, the annular protruding portion 5*b* is engaged with the annular groove portion 2*e* of the cartridge accommodating container 2 in the axial direction, and the outer peripheral surface of the main body portion 5*x* is fitted to the inner peripheral surface of the cartridge accommodating container 2, whereby the middle piece 5 is installed to the cartridge accommodating container 2 so as to be synchronously rotatable and be undetachable in the axial direction.

The stick-shaped cosmetic material cartridge 1 is, roughly speaking, structured such as to be provided with the cartridge tube 4 formed in the stepped tube shape as an outer shape structure as shown in FIG. 7, and the stick-shaped cosmetic material M, a stick-shaped cosmetic material support body 7 supporting the stick-shaped cosmetic material M, and a thread tube 6 constituting an engagement mechanism are accommodated within the cartridge tube 4, as shown in FIGS. 2 and 3.

As shown in FIGS. 2, 8 and 9, the cartridge tube 4 is provided with an outer diameter large-diameter portion 4*x* serving as a grip portion at a front half side protruding from the middle piece 5 of the cartridge accommodating container 2, and an outer diameter small-diameter portion 4*y* at a rear half side connected to a rear end of the outer diameter large-diameter portion 4*x* via a step surface 4*i*, as shown in FIGS. 8 and 9.

The outer diameter large-diameter portion 4*x* is structured such that an outer surface from the step surface 4*i* to a portion near the step portion 4*i* is structured in a circular shape, and an outer surface (a surface in a vertical direction to the paper surface in FIG. 2; a surface in a parallel direction to the paper surface in FIG. 3) from the circular outer surface to a leading end, that is, the outer surface corresponding to the outer peripheral surface Mb at the short diameter side of the accommodated stick-shaped cosmetic material M, is formed as an outer surface which is tapered gradually toward the leading end. Further, a leading end surface 70 of the outer diameter large-diameter portion 4*x* is formed approximately in a rectangular shape as seen from a front surface (as seen from a left side in the drawing), as shown in FIG. 8. Further, in this case, the leading end surface 70 of the outer diameter large-diameter portion 4*x* is formed as an inclined surface which inclines with respect to a surface being orthogonal to the axis as seen in a vertical direction to the paper surface in FIG. 2, as shown in FIG. 2.

As shown in FIGS. 8 and 9, the outer diameter small-diameter portion 4*y* is formed approximately in a cylindrical shape, and is made smaller than an inner diameter of the cartridge accommodating container 2 so as to be freely inserted.

A tube hole passing through the cartridge tube 4 in the axial direction is provided with an intermediate region 4*b* in a middle in the axial direction thereof, as shown in FIGS. 2, 3 and 9, a range from the leading end to a leading end of the intermediate region 4*b* is formed as a forward and backward moving hole 4*a*, in which the stick-shaped cosmetic material M and a support piece 7*b* mentioned below supporting the stick-shaped cosmetic material M are accommodated, and in which these elements move forward and backward, and a range from a rear end of the intermediate region 4*b* to a tube rear end is formed as a thread tube accommodating hole 4*c* accommodating the thread tube 6.

The forward and backward moving hole 4*a* is formed in a cross sectional shape having a long diameter and a short diameter as shown in FIGS. 2 to 4, has short diameter side inner peripheral surfaces 4*aa*, which are parallel and flat, at the short diameter side as shown in FIG. 4, and is structured such that inner peripheral surfaces 4*ab* in four corners (inner peripheral surfaces at the support piece 7*b* side; the support piece 7*b* is described later) do not protrude to an outer side in a short diameter direction (a lateral direction in the drawing) than the short diameter side inner peripheral surfaces 4*aa*. In this case, the forward and backward moving hole 4*a* is formed approximately in a rectangular cross sectional shape, and is structured such that long diameter side peripheral walls constituting the forward and backward moving hole 4*a* are protruded to an inner side, and inner peripheral surfaces 4*ac* at a long diameter side of the forward and backward moving hole 4*a* constitute leading end surfaces of the protruded portions and are formed as flat surfaces, as shown in FIGS. 4 and 9.

As shown in FIGS. 2, 3 and 9, the thread tube accommodating hole 4*c* is formed approximately in a circular cross sectional shape, and an inner diameter thereof is made smaller than a long diameter of the forward and backward moving hole 4*a*. In the thread tube accommodating hole 4*c*, as shown in FIG. 9, an annular concavo-convex portion (in which concave and convex portions are arranged in the axial direction) 4*d* for engaging the thread tube 6 in the axial direction is formed at a position close to the rear end.

The intermediate region 4*b* is structured such as to be connected to the rear end at the long diameter side of the forward and backward moving hole 4*a* via a step surface 4*m* in such a manner that an inner periphery is made small in diameter (connected to the short diameter side in the same diameter), as shown in FIGS. 2, 3 and 9, and be connected to the leading end of the thread tube accommodating hole 4*c* via a step surface 4*n* in such a manner that the inner periphery is made small in diameter, thereby being formed as a non-circular hole. The step surface 4*m* in a boundary portion between the intermediate region 4*b* and the forward and backward moving hole 4*a* serves as a rear end limit with which a rear end surface of a support piece 7*b* of the stick-shaped cosmetic material support body 7 is brought into contact at a time when the stick-shaped cosmetic material support body 7 is moved backward.

Further, the intermediate region 4*b* is provided with an engagement piece 4*e* extending in the axial direction, as a rotation prevention constructing one of rotation preventing portions (rotation preventing mechanisms) 60 of the stick-shaped cosmetic material support body 7, as shown in FIGS. 3 and 9. The engagement piece 4*e* serves as a forward moving limit with which a rear end surface of a concave groove 7*k* of the stick-shaped cosmetic material support body 7 is brought into contact at a time when the stick-shaped cosmetic material support body 7 moves forward.

Further, an annular groove portion 4*f* is provided as a structure of being detachably engaged with the protruding portion 5*d* of the spring portion 5*y* of the middle piece 5 in the axial direction, as shown in FIGS. 8 and 9, on an outer peripheral surface of a rear end portion of the cartridge tube 4.

Further, an annular groove 4*p* is provided on an outer peripheral surface close to the step surface 4*i* of the outer diameter small-diameter portion 4*y* of the cartridge tube 4, and an O-ring 8 is installed to the annular groove 4*p*, as shown in FIGS. 2 and 3. The O-ring 8 is elastically brought into contact with the middle piece 5, and is provided for applying a good rotational resistance between the cartridge tube 4 and the middle piece 5 and preventing a rattling motion in the diametrical direction.

The thread tube 6 is formed approximately in a cylindrical shape, as shown in FIGS. 8 and 9, and is formed by integrally molding a main body portion 6*x*, and a gear portion 6*y* connected to a rear end of the main body portion 6*x* via a step surface 6*f* in such a manner that an outer peripheral surface is made large in diameter, for example, by a flexible material such as a synthetic resin or the like.

The thread tube 6 is provided with an engagement projection 6*a* serving as a female thread constituting one of engagement portions (engagement mechanisms) 50 at each of positions close to a leading end of an inner peripheral surface thereof, the positions being symmetrical at 180 degree with respect to the axis.

Further, the thread tube 6 is provided with elastic engagement portions 6*b* and 6*b* at symmetrical positions at 180 degree with respect to the axis at positions close to the gear portion 6*y* of the main body portion 6*x*. The elastic engagement portion 6*b* is formed by an angular C-shaped slot 6*c* pierced in the peripheral wall of the main body portion 6*x* of the thread tube 6, and is provided with a peninsular portion 6*d* serving as a leaf spring in accordance with a flexibility of the synthetic resin or the like corresponding to the molding material, and a protruding portion 6*e* protruding from an outer peripheral surface of the peninsular portion 6*d*. The protruding portion 6*e* is elastically brought into contact with an inner peripheral surface of the cartridge tube 4, as shown in FIG. 2, and is provided for applying a good rotational resistance to a portion between the cartridge tube 4 and the thread tube 6, and preventing the rattling motion in the diametrical direction.

Further, as shown in FIGS. 8 and 9, an annular concavo-convex portion (in which concave and convex portions are arranged in the axial direction) 6*g* is provided as a structure engaging with the annular concavo-convex portion 4*d* of the cartridge tube 4 in the axial direction, at an outer peripheral position close to the elastic engagement portion 6*b* of the main body portion 6*x*.

Further, an outer peripheral surface of the gear portion 6*y* of the thread tube 6 is provided with a rib 6*h* having a chevron cross sectional shape and extending along the axial direction as a structure engaging with the upper stage rib 2*y* of the cartridge accommodating container 2 in a rotating direction, at each of eight uniformly arranged positions.

The thread tube 6 is inserted into the thread tube accommodating hole 4*c* of the cartridge tube 4, as shown in FIGS. 2 and 3. The step surface 6*f* is contacted with the rear end surface of the cartridge tube 4, the protruding portion 6*e* of the peninsula portion 6*d* is brought into contact with the inner peripheral surface of the cartridge 4, and the annular concavo-convex portion 6*g* is engaged with the annular concavo-convex portion 4*d* of the cartridge tube 4 in the axial direction, whereby the thread tube 6 is installed to the cartridge tube 4 so as to be relatively rotatable and be undetachable in the axial direction.

The stick-shaped cosmetic material support body 7 is formed, for example, by a flexible material such as a synthetic resin or the like, and is integrally provided with a base portion 7*a* for applying the rear end surface of the stick-shaped cosmetic material M, four pieces of support pieces 7*b* for supporting the rear end portion of the stick-shaped cosmetic material M contacted with the base portion 7*a*, and is further provided with a shaft body portion 7*c* extending rearward at a rear side of the base portion 7*a*, as shown in FIGS. 2, 3 and 10.

As shown in FIG. 10, the base portion 7*a* is formed in a shape which approximately accords with a cross sectional shape of the stick-shaped cosmetic material M in a front view, and is provided with support pieces 7*b* protruding to a front side between a short diameter side outer peripheral surfaces and a long diameter side outer peripheral surfaces.

As shown in FIG. 4, an inner peripheral surface 7*ba* of the support piece 7*b* is formed as an inclined surface corresponding to the inclined surface Ma of the stick-shaped cosmetic material M, and an outer peripheral surface 7*bb* at an outer side in the short diameter direction of the support piece 7*b* is structured such as not to protrude to an outer side in the short diameter direction than the outer peripheral surface at the short diameter side of the base portion 7*a* (the outer peripheral surface Mb at the short diameter side of the stick-shaped cosmetic material M). In this case, the outer peripheral surface 7*bb* at the outer side in the short diameter direction of the support piece 7*b* is approximately made flush with the outer peripheral surface at the short diameter side of the base portion 7*a* (the outer peripheral surface Mb at the short diameter side of the stick-shaped cosmetic material M). Further, an outer peripheral surface at an outer side in a long diameter direction of the support piece 7*b* is structured such as to protrude to an outer side in the long diameter direction than the outer peripheral surface at the long diameter side of the base portion 7*a* (an outer peripheral surface Mc at the long diameter side of the stick-shaped cosmetic material M). Further, the support pieces 7*b* respectively support the inclined surfaces Ma of the stick-shaped cosmetic material M.

In this case, an inner surface of each of the support pieces 7*b* is provided with a protrusion 7*d* extending in the axial direction, as shown in FIG. 10. The protrusion 7*d* is provided for increasing a contact area with the stick-shaped cosmetic material M so as to increase a friction resistance by biting the outer peripheral surface of the inserted stick-shaped cosmetic material M, and inhibiting the stick-shaped cosmetic material M from rotating.

Further, the base portion 7*a* is provided with a coupling tube portion 7*e*, which extends short toward a rear side and in which a cross sectional shape of the extending portion is formed in a shape obtained by shortening the long diameter side portion of the cross sectional shape of the stick-shaped cosmetic material M, at a rear end of the base portion 7*a*. The coupling tube portion 7*e* is structured in a closed-end tubular shape, and a small-diameter opening 7*f* is provided in a closed-end portion at a rear end. A surface around a front side of the opening 7*f* in the closed-end portion is provided for inhibiting the shaft body portion 7*c* from moving to the rear side, and a surface around a rear side of the opening 7*f* in the closed-end portion is provided for inhibiting the shaft body portion 7*c* from moving to the front side.

The shaft body portion 7*c* is provided with a small-diameter shaft 7*g* at a leading end, and a small-diameter annular protruding portion 7*h* is provided as a structure engaging with the surface around the front side of the opening 7*f* in the closed-end portion in the axial direction, on an outer periphery of the small-diameter shaft 7*g*. Further, a large-diameter annular collar portion 7*i* is provided as a structure engaging with the surface around the rear side of the opening 7*f* in the closed-end portion in the axial direction, near a rear side than the annular protruding portion 7*h* of the shaft body portion 7*c*. Further, a shaft portion at a rear side than the annular collar portion 7*i* of the shaft body portion 7*c* is made smaller in diameter than the annular collar portion 7*i*, and is structured such as to be provided with a male thread 7*j* constituting the other of the engagement portions (the engagement mechanisms) 50. Further, a concave groove 7*k* serving as a rotation prevention constituting the other of the rotation preventing portions (the rotation preventing mechanisms) 60 of the stick-shaped cosmetic material support body 7 is provided at each of symmetrical positions at 180 degree with respect to the axis, from a leading end of the annular collar portion 7*i* of the shaft body portion 7*c* to a portion near the rear end portion of the shaft body portion 7*c*.

The shaft body portion 7*c* is structured, as shown in FIGS. 2 and 3, such that the small-diameter shaft 7*g* is inserted through the opening 7*f* of the coupling tube portion 7*e* of the base portion 7*a*, the annular protruding portion 7*h* enters into the coupling tube portion 7*e*, the rear end surface of the annular protruding portion 7*h* of the shaft body portion 7*c* faces to the surface around the front side of the opening 7*f* in the closed-end portion, and the leading end surface of the annular collar portion 7*i* of the shaft body portion 7*c* faces to the surface around the rear side of the opening 7*f* in the closed-end portion, whereby the shaft body portion 7*c* is installed to the base portion 7*a* so as to be relatively rotatable and be immovable in the axial direction. In this case, the base portion 7*a* and the shaft body portion 7*c* may be structured such as to be synchronously movable.

Further, in the stick-shaped cosmetic material support body 7, the shaft body 7*c* is inserted into the thread tube 6, and the male thread 7*j* is engaged with the thread projection 6*a* of the thread tube 6, whereby the engagement portion 50 is constituted. Further, as shown in FIG. 3, the engagement piece 4*e* of the intermediate region 4*b* of the cartridge tube 4 enters into the concave groove 7*k* so as to be engaged in the rotating direction, whereby the rotation preventing portion 60 of the stick-shaped cosmetic material support body 7 is constituted, and the base portion 7*a*, the support piece 7*b* and the stick-shaped cosmetic material M are inserted to enter into the forward and backward moving hole 4*a* of the cartridge 4.

In this state, as shown in FIG. 4, there is formed a state in which the short diameter side inner peripheral surface 4*aa* of the forward and backward moving hole 4*a* comes close to the short diameter side outer peripheral surface Mb of the stick-shaped cosmetic material M, the inner peripheral surface (the inner peripheral surface in four corners) 4*ab* at the support piece 7*b* side of the forward and backward moving hole 4*a* comes close to the outer peripheral surface of the support piece 7*b*, and the long diameter side inner peripheral surface (the convex surface) 4*ac* of the forward and backward moving hole 4*a* comes close to the outer peripheral surface Mc at the long diameter side of the stick-shaped cosmetic material M.

Next, a description will be given of an assembling procedure of the stick-shaped cosmetic material cartridge 1 having the structure mentioned above. In this case, in the present embodiment, since the long diameter of the forward and backward moving hole 4*a* is made larger than the outer diameter of the thread tube 6 as shown in FIG. 2 so as to be applied to the stick-shaped cosmetic material M which is made comparatively larger in diameter in the long diameter direction, the base portion 7*a* of the stick-shaped cosmetic material support body 7 is inserted from the opening (the leading end of the forward and backward moving hole 4*a*) at the leading end of the cartridge tube 4.

Accordingly, the shaft body portion 7*c* constructing the stick-shaped cosmetic material support body 7 is first engaged with the thread tube 6, and the thread tube 6 with which the shaft body portion 7*c* is engaged is next inserted into the opening at the rear end of the cartridge tube 4 from the small-diameter shaft 7*g* side at the leading end side of the shaft body portion 7*c* in such a manner that the engagement piece 4*e* of the cartridge tube 4 fits to the concave groove 7*k* of the shaft body portion 7*c*, thereby being installed to the cartridge tube 4. Next, the stick-shaped cosmetic material support body 7 is integrated by inserting the base portion 7*a* constructing the stick-shaped cosmetic material support body 7 into the opening at the leading end of the cartridge tube 4, and pressing the coupling tube portion 7*e* to the small-diameter shaft 7*g*. Then, the stick-shaped cosmetic material cartridge 1 shown in FIG. 7 is obtained by inserting the stick-shaped cosmetic material M into the opening at the leading end of the cartridge tube 4 from the rear end portion so as to be supported by the support pieces 7*b* of the stick-shaped cosmetic material support body 7. In this case, the stick-shaped cosmetic material support body 7 is structured such that the rear end surface of the concave groove 7*k* contacts the engagement piece 4*e* of the cartridge tube 4, thereby forming the forward moving limit, and does neither appear from the cartridge tube 4 nor break away from the cartridge tube 4.

Further, as shown in FIGS. 2 and 3, the stick-shaped cosmetic material cartridge 1 obtained as mentioned above is inserted into the opening at the leading end of the cartridge accommodating container 2 via the middle piece 5 from the rear end side, and the step surface 4*i* of the cartridge tube 4 is contacted to the leading end surface of the middle piece 5. Accordingly, the annular groove portion 4*f* of the cartridge tube 4 is engaged with the protruding portion 5*d* of the spring portion 5*y* of the middle piece 5 in the axial direction, the cartridge tube 4 is detachably installed to the cartridge accommodating container 2 via the middle piece 5 so as to be relatively rotatable and be detachable in the axial direction, and the upper stage rib 2*y* of the cartridge accommodating container 2 is positioned between the ribs 6*h* and 6*h* of the thread tube 6 so as to be engaged in the rotating direction, in this state, the thread tube 6 is installed to the cartridge accommodating container 2 so as to be synchronously rotatable and be movable in the axial direction, whereby it is possible to obtain the stick-shaped cosmetic material feeding container 100 to which the stick-shaped cosmetic material cartridge 1 shown in FIGS. 1 to 3 is installed.

On the other hand, the stick-shaped cosmetic material sharpener 3 installed to the other end side of the cartridge accommodating container 2 of the stick-shaped cosmetic material feeding container 100 is provided for sharpening the leading end portion of the stick-shaped cosmetic material M in a two-edged shape as seen in the long diameter direction, as shown in FIG. 1.

The stick-shaped cosmetic material sharpener 3 is structured, as shown in FIGS. 2 and 3, and FIGS. 11 and 12, such as to be provided with a sharpening portion 3*x* for sharpening the stick-shaped cosmetic material M, an installation portion 3*y* for detachably installing to the cartridge accommodating container 2, and a grip portion 3*z* for being gripped by a user. The sharpening portion 3*x*, the installation portion 3*y* and the grip portion 3*z* are integrally molded by a same plastic material.

The sharpening portion 3*x* is approximately provided with a sliding portion 3*a*, a blade 3*b* and a slit 3*c*.

The sliding portion 3*a* is constituted by a plate-like member and is structured such as to have a sliding surface 3*d* at an upper side. The sliding surface 3*d* is provided for applying the leading end portion of the stick-shaped cosmetic material M so as to achieve a sliding motion in a longitudinal direction (a lateral direction in the drawing), and is formed at a front side (a right side in the drawing) of the slit 3*c*. The sliding surface 3*d* is formed in a V-shape (refer to FIG. 15) having an acute inner angle θ in a view in the longitudinal direction. Further, the plate-like member having the sliding surface 3*d* at the upper side is formed in the similar V-shape to the sliding surface 3*d* of a back surface.

The blade 3*b* is constituted by a plate-like member, and is provided in such a manner that a cutting edge 3*e* headed for a front side faces to a rear end edge 3*f* of the sliding surface 3*d* at a position which is slightly higher than the sliding surface 3*d*. The blade 3*b* is structured such that a single edged blade having a blade back at an upper side is used for a cutting blade, and is structured such as to have a continuous surface 3*g* at an upper side.

The continuous surface 3*g* allows a continuous sliding motion from the sliding motion executed by applying the leading end portion of the stick-shaped cosmetic material M to the sliding surface 3*d*, and is formed at a rear side (a left side in the drawing) of the slit 3*c*. It is possible to execute the continuous sliding motion from the sliding motion executed by applying the leading end portion of the stick-shaped cosmetic material M to the sliding surface 3*d*, on the basis of the continuous surface 3*g* mentioned above, and it is possible to sharpen the leading end portion of the stick-shaped cosmetic material M in the two-edged shape in the view in the longitudinal direction through the continuous sliding motion.

In this case, the blade 3*b* is formed in the V-shape formed to have the same acute inner angle θ as that of the sliding surface 3*d* in the view in the longitudinal direction, as shown in FIG. 15. Further, as shown in FIGS. 2 and 3, and FIGS. 11 and 12, the back surface of the plate-like member, which has the continuous surface 3*g* at the upper side as well as having the cutting edge 3*e* at the front side, is also formed in the same V-shape as the continuous surface 3*g*.

The slit 3*c* is provided between the sliding surface 3*d* and the continuous surface 3*g*, is formed in the V-shape in the view in the longitudinal direction, and is provided for bringing down a sharpening waste generated by the sharpening operation through the sliding motion executed over the continuous surface 3*g* and the sliding surface 3*d*.

Further, guide rails 3*h* extending in the longitudinal direction over the sliding surface 3*d* and the continuous surface 3*g* are provided at the upper side than the sliding portion 3*a*, the blade 3*b* and the slit 3*c*. The guide rails 3*h* are provided for guiding the leading end portion of the stick-shaped cosmetic material feeding container 100 in a direction of sharpening the leading end portion of the stick-shaped cosmetic material M fed out from the stick-shaped cosmetic material feeding container 100 into the two-edged shape.

Specifically, the guide rails 3*h* are respectively provided at the upper sides than the sliding surface 3*d* and the continuous surface 3*g* in such a manner as to face to each other so as to sandwich the sliding surface 3*d* and the continuous surface 3*g*, and are provided as a pair of step portions having a bottom portion 3*ha* regulating an oscillation in the vertical direction at a time when the leading end of the stick-shaped cosmetic material feeding container 100 slides, and a side portion 3*hb* regulating an oscillation in the lateral direction.

Further, as shown in FIGS. 11 and 12, the sharpening portion 3*x* provided with the sliding portion 3*a*, the blade 3*b*, the slit 3*c* and the guide rails 3*h* is structured such that outer peripheral surfaces at side portions in the lateral direction in the view in the longitudinal direction are formed as circular arc surfaces so as to be accommodated within the cartridge accommodating container 2, and is structured approximately in an M-shape in the view in the longitudinal direction.

The installation portion 3*y* is continuously provided on a front surface (a right end surface in the drawing) of the plate-like member having the sliding surface 3*d* of the sharpening portion 3*x* at an upper side, and is structured as a closed-end cylindrical shape approximately the same diameter as the outer peripheral circular arc surfaces of the sharpening portion 3*x*. A male thread 3*i* is provided on an outer peripheral surface of the installation portion 3*y* so as to be engaged with the female thread 2*f* of the cartridge accommodating container 2.

The grip portion 3*z* is continuously provided on a front surface of the installation portion 3*y*, and is structured in a cylindrical shape having a larger diameter than the installation portion 3*y*. An annular protruding portion 3*j* for installing the tail valve 10 is provided on an inner peripheral surface at a front side of the grip portion 3*z*.

The tail valve 10 is provided for closing tube holes in the installation portion 3*y* and the grip portion 3*z* from the external, is structured in a closed-end cylindrical shape, and is provided with a collar portion 10*a* at a bottom portion. An annular groove portion 10*b* is provided as a structure engaging with the annular protruding portion 3*j* of the grip portion 3*z* on an outer peripheral surface of the tail valve 10.

The tail valve 10 is structured, as shown in FIGS. 2 and 3, such that a portion at a rear side from the collar portion 10*a* is inserted into the tube hole of the grip portion 3*z* of the stick-shaped cosmetic material sharpener 3, and the annular groove portion 10*b* is engaged with the annular protruding portion 3*j* of the grip portion 3*z*, whereby the tail valve 10 is installed to the stick-shaped cosmetic material sharpener 3.

Further, the stick-shaped cosmetic material sharpener 3 covered by the tail valve 10 is structured such that the sharpening portion 3*x* and the installation portion 3*y* are inserted into the cartridge accommodating container 2, and the male thread 3*i* of the installation portion 3*y* is engaged with the female thread 2*f* of the cartridge accommodating container 2, whereby the stick-shaped cosmetic material sharpener 3 is detachably installed to the cartridge accommodating container 2. The stick-shaped cosmetic material feeding container 100 shown in FIGS. 1 to 3. can be thus obtained.

In the stick-shaped cosmetic material feeding container 100 mentioned above, as shown in FIG. 4, there is employed the stick-shaped cosmetic material M in which the cross sectional shape is formed in a shape having the long diameter and the short diameter, four support pieces 7*b* of the stick-shaped cosmetic material support body 7 supporting the rear end portion of the stick-shaped cosmetic material M are structured such as to respectively support the inclined surfaces Ma between the long diameter and the short diameter of the stick-shaped cosmetic material M, the forward and backward moving hole 4*a*, in which the stick-shaped cosmetic material M and the support piece 7*b* move forward and backward, is formed in the cross sectional shape having the long diameter and the short diameter, and has the flat short diameter side inner peripheral surface 4*aa* at the short diameter side, the short diameter side inner peripheral surfaces 4*aa* come close to the outer peripheral surfaces Mb at the short diameter side of the stick-shaped cosmetic material M, and the inner peripheral surfaces 4*ab* at the support piece 7*b* side are structured such as to come close to the outer peripheral surfaces 7*bb* at an outer side in a direction of the short diameter of the support piece 7*b*. Accordingly, the stick-shaped cosmetic material M formed in the cross sectional shape having the long diameter and the short diameter, and the support piece 7*b* supporting the stick-shaped cosmetic material M are efficiently accommodated within the container 100 (the cartridge tube 4) so as to be movable forward and backward, and the leading end side of the container 100 is formed in a slim and compact shape.

Further, since the forward and backward moving hole 4*a* is formed as the hole in which the cross sectional shape is approximately the rectangular shape, the shape of the forward and backward moving hole 4*a* is simple, and it is easy to manufacture the forward and backward moving hole 4*a*.

Next, a description will be given of a use of the stick-shaped cosmetic material feeding container 100. When a user relatively rotates in one direction while holding the cartridge accommodating container 2, and the outer diameter large-diameter portion 4*x* protruding from the cartridge accommodating container 2 in the cartridge tube 4 of the stick-shaped cosmetic material cartridge 1, the stick-shaped cosmetic material support body 7 is moved forward in accordance with the thread portion 50 constituted by the engagement projection 6*a* of the thread tube 6 and the male thread 7*j* of the stick-shaped cosmetic material support body 7, and the rotation preventing portion 60 constituted by the concave groove 7*k* of the stick-shaped cosmetic material support body 7 and the engagement piece 4*e* of the cartridge tube 4, so that the stick-shaped cosmetic material M appears from the leading end of the cartridge tube 4 and becomes ready to apply.

At the time of applying the stick-shaped cosmetic material M which appears from the leading end of the cartridge tube 4, the thick line can be formed by drawing the stick-shaped cosmetic material M in the direction of the short diameter, and the thin line can be formed by drawing the stick-shaped cosmetic material M in the direction of the long diameter, respectively. Accordingly, it is possible to draw the desired thin and thick lines.

Further, when the user relatively rotates the cartridge accommodating container 2 and the cartridge tube 4 of the stick-shaped cosmetic material cartridge 1 in the other direction corresponding to the opposite direction to one direction, the stick-shaped cosmetic material support body 7 is moved backward, and the stick-shaped cosmetic material M is brought inside from the leading end of the cartridge tube 4.

In this case, if impulsive external force is applied, for example, by dropping the stick-shaped cosmetic material feeding container 100 on the floor or the like, the stick-shaped cosmetic material cartridge 1 is moved according to an expansion and contraction amount of the spring portion 5*y* of the middle piece 5 in the axial direction, and the shock is thereby buffered so as to prevent the stick-shaped cosmetic material M within the stick-shaped cosmetic material cartridge 1 from jumping out or being broken.

Further, in the present embodiment, since the flat short diameter side inner peripheral surfaces 4*aa* at the short diameter side of the forward and backward moving hole 4*a* come close to the outer peripheral surfaces Mb at the short diameter side of the stick-shaped cosmetic material M, the outer surface Mb at the short diameter side of the stick-shaped cosmetic material M is immediately borne by the short diameter side inner peripheral surface 4*aa* of the forward and backward moving hole 4*a* which is close to the outer surface Mb, even if the stress is applied in the direction of the short diameter of the stick-shaped cosmetic material M which has a small thickness and is comparatively weak against the stress. Accordingly, it is possible to prevent the stick-shaped cosmetic material M from being broken by the stress in the direction of the short diameter.

Further, since the inner peripheral surfaces 4*ac* at the long diameter side of the forward and backward moving hole 4*a* come close to the outer peripheral surfaces Mc at the long diameter side of the stick-shaped cosmetic material M, in addition that the stick-shaped cosmetic material M has the large thickness in the direction of the long diameter and is comparatively strong against the stress in the direction of the long diameter accordingly so as to be hardly broken, the outer surface Mc at the long diameter side of the stick-shaped cosmetic material M is immediately borne by the inner peripheral surface 4*ac* at the long diameter side of the forward and backward moving hole 4*a* which comes close to the outer surface Mc even if the stress is applied in the direction of the long diameter of the stick-shaped cosmetic material M, so that it is possible to prevent the stick-shaped cosmetic material M from being broken by the stress in the direction of the long diameter.

Next, a description will be given of the case that the leading end portion of the stick-shaped cosmetic material M is rounded by the use of the stick-shaped cosmetic material M, and the sharpening work of the leading end portion is executed. In this case, the stick-shaped cosmetic material sharpener 3 is detached from the cartridge accommodating container 2 by canceling the engagement of the stick-shaped cosmetic material sharpener 3, and the sharpening work is executed while holding the cartridge accommodating container 2 by one hand and holding the stick-shaped cosmetic material sharpener 3 by the other hand. Although it is possible to execute the sharpening work by detaching the stick-shaped cosmetic material cartridge 1 from the cartridge accommodating container 2 and holding the stick-shaped cosmetic material cartridge 1, in this case, the sharpening work is executed while holding the cartridge accommodating container 2.

In the sharpening work, as shown in FIGS. 13 to 15, the user applies the whole surface of the leading end surface 70 of the stick-shaped cosmetic material feeding container 100 to the bottom portions 3*ha* of the guide rails 3*h* in a state in which the stick-shaped cosmetic material M emerges from the leading end of the stick-shaped cosmetic material cartridge 1 (the cartridge tube 4) (refer to FIG. 15). At this time, a protruding amount of the stick-shaped cosmetic material M from the container 100 is set to an amount capable of sharpening the leading end portion of the stick-shaped cosmetic material M, preferably in specific, an amount at which the leading end surface of the stick-shaped cosmetic material M is brought into contact with the sliding surface 3*d*.

Further, in this state, the user moves the stick-shaped cosmetic material feeding container 100 in the longitudinal direction while being guided along the guide rails 3*h*. It is possible to prevent the leading end portion of the stick-shaped cosmetic material feeding container 100 from being shaken at a time of sharpening, by being guided along the guide rails 3*h*, and it is possible to stably obtain a desired two-edged shape.

Specifically, it is possible to regulate the shake in the vertical direction at a time of sliding of the leading end portion of the stick-shaped cosmetic material feeding container 100, by the bottom portions 3*ha* of the guide rails 3*h*, and it is possible to regulate the shake in the lateral direction at a time of sliding of the leading end portion of the stick-shaped cosmetic material feeding container 100, by the side portions 3*hb* of the guide rails 3*h*. Accordingly, it is possible to securely prevent the shake of the leading end portion of the stick-shaped cosmetic material feeding container 100 at a time of sharpening, and it is possible to stably obtain a desired two-edged shape.

In other words, a user having no special technique can execute the sharpening work of the leading end portion of the stick-shaped cosmetic material M securely in a short time, and it is possible to stably obtain the desired two-edged shape.

Further, in the stick-shaped cosmetic material sharpener 3, since it is possible to execute the sharpening work without directly holding the stick-shaped cosmetic material M, it is possible to prevent the user's hands from being soiled.

In the case that the sharpening work is executed while holding the stick-shaped cosmetic material cartridge 1, the sharpening work is executed by utilizing the guide rails 3*h* in the same manner as mentioned above, with the leading end portion of the stick-shaped cosmetic material cartridge 1 instead of the leading end portion of the stick-shaped cosmetic material feeding container.

As described above, particularly in the present embodiment, since it is possible to sharpen the stick-shaped cosmetic material M in the double-edged shape by holding the stick-shaped cosmetic material feeding container 100 or the stick-shaped cosmetic material cartridge 1 and utilizing the guide by means of the guide rails 3*h*, at a time of sharpening the stick-shaped cosmetic material M by using the stick-shaped cosmetic material sharpener 3, it is possible to stably obtain the desired two-edged shape without soiling the user's hands.

Further, particularly in the present embodiment, it is possible to form the leading end side of the container 100 in the slim and compact shape, by designing the shapes of the support pieces 7*b* and the forward and backward moving hole 4*a* as mentioned above.

Figure 16:
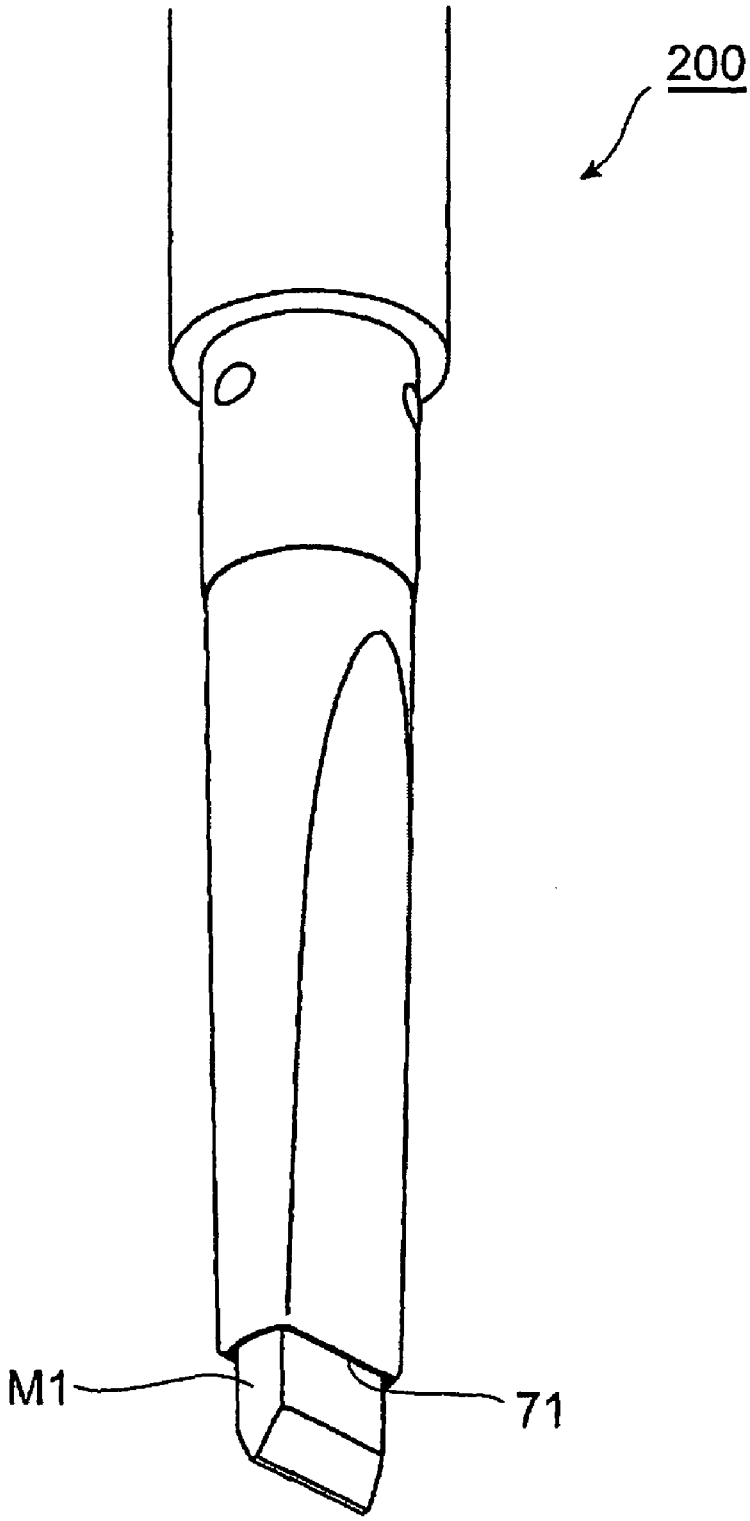
FIG. 16 is a perspective view showing a state after being sharpened by using a stick-shaped cosmetic material feeding container having another stick-shaped cosmetic material which is different from the stick-shaped cosmetic material in FIG. 10 and provided with another leading end surface which is different from FIG. 2, and using the sharpener for the stick-shaped cosmetic material shown in FIGS. 11 and 12.
Figure 17:
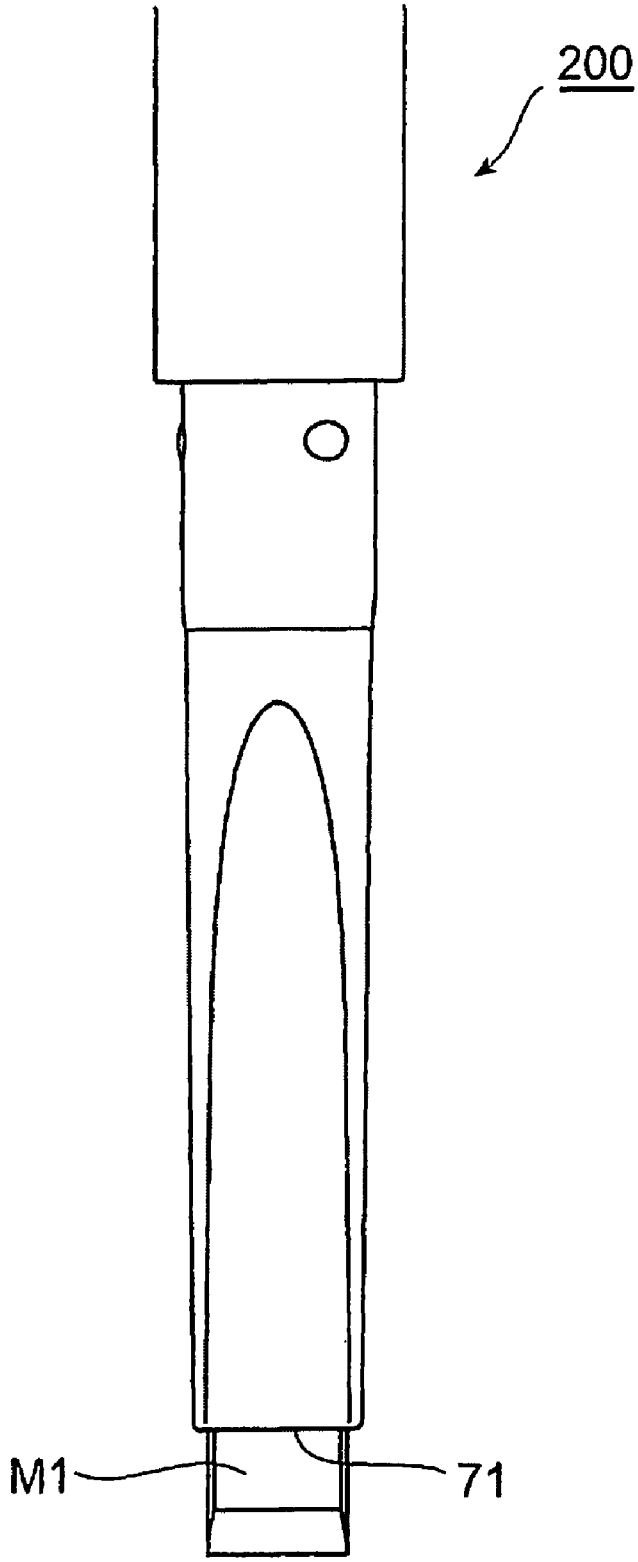
FIG. 17 is a side view of FIG. 16.

FIG. 16 is a perspective view showing a state of sharpening by using a stick-shaped cosmetic material feeding container 200 having another stick-shaped cosmetic material M1 which is different from the stick-shaped cosmetic material M in FIG. 10 and provided with another leading end surface 71 which is different from FIG. 2, and using the sharpener 3 for the stick-shaped cosmetic material shown in FIGS. 11 and 12. FIG. 17 is a side view of FIG. 16.

The stick-shaped cosmetic material M1 is constituted by a stick-shaped cosmetic material having a rectangular cross sectional shape. The leading end surface 71 of the container 200 is formed as a flat surface (called as a horizontal surface here for convenience of explanation) which is in parallel to a plane orthogonal to an axis as seen from a vertical direction to the paper surface in FIG. 17. Further, the structure is made such that an outer diameter at a rear side of the container 200 is larger than a front side of the container 200, and an assembly can be achieved by inserting a base portion and a support pieces constituting the front side of the stick-shaped cosmetic material support body from a rear side of the container 200. Accordingly, the structure is made such that the whole of an inner peripheral surface of an opening of the container 200 is close to an outer peripheral surface of the stick-shaped cosmetic material M1.

If the same sharpening work into a double-edged shape as mentioned above is executed by using the stick-shaped cosmetic material M1 and the container 200 structured as mentioned above, using the sharpener 3 for the stick-shaped cosmetic material, applying the horizontal surface 71 corresponding to the leading end surface of the container 200 to the bottom portions 3*ha* of the guide rails 3*h* and using the guide rails 3*h* as a guide, the leading end of the stick-shaped cosmetic material M1 is formed in a parallel shape copying from the horizontal surface 71 of the container 200, as shown in FIG. 17.

Figure 18:
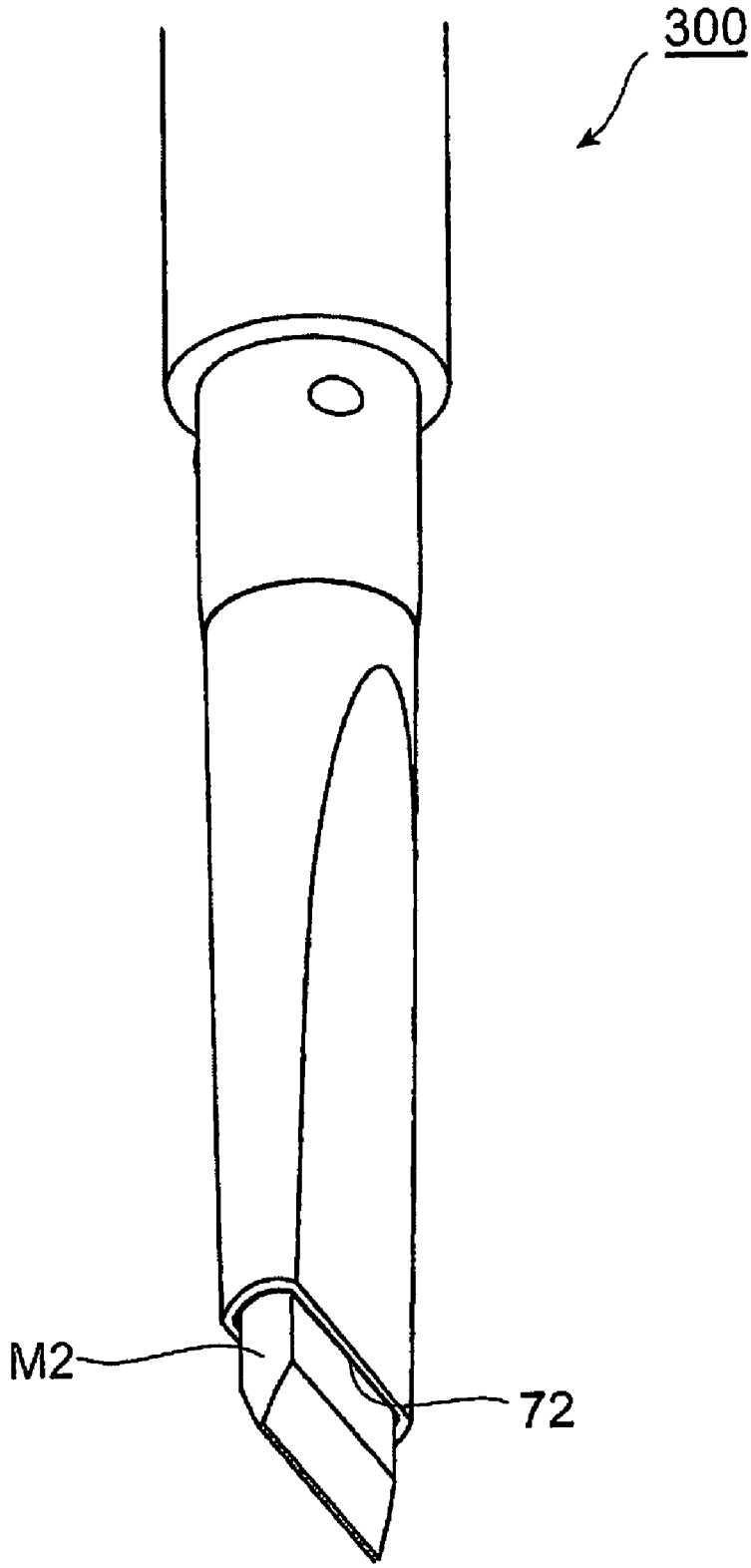
FIG. 18 is a perspective view showing a state after being sharpened by using a stick-shaped cosmetic material feeding container having a stick-shaped cosmetic material which has the same rectangular cross sectional shape as that of the stick-shaped cosmetic material in FIG. 16 and provided with another leading end surface which is different from FIG. 16, and using the sharpener for the stick-shaped cosmetic material shown in FIGS. 11 and 12.
Figure 19:
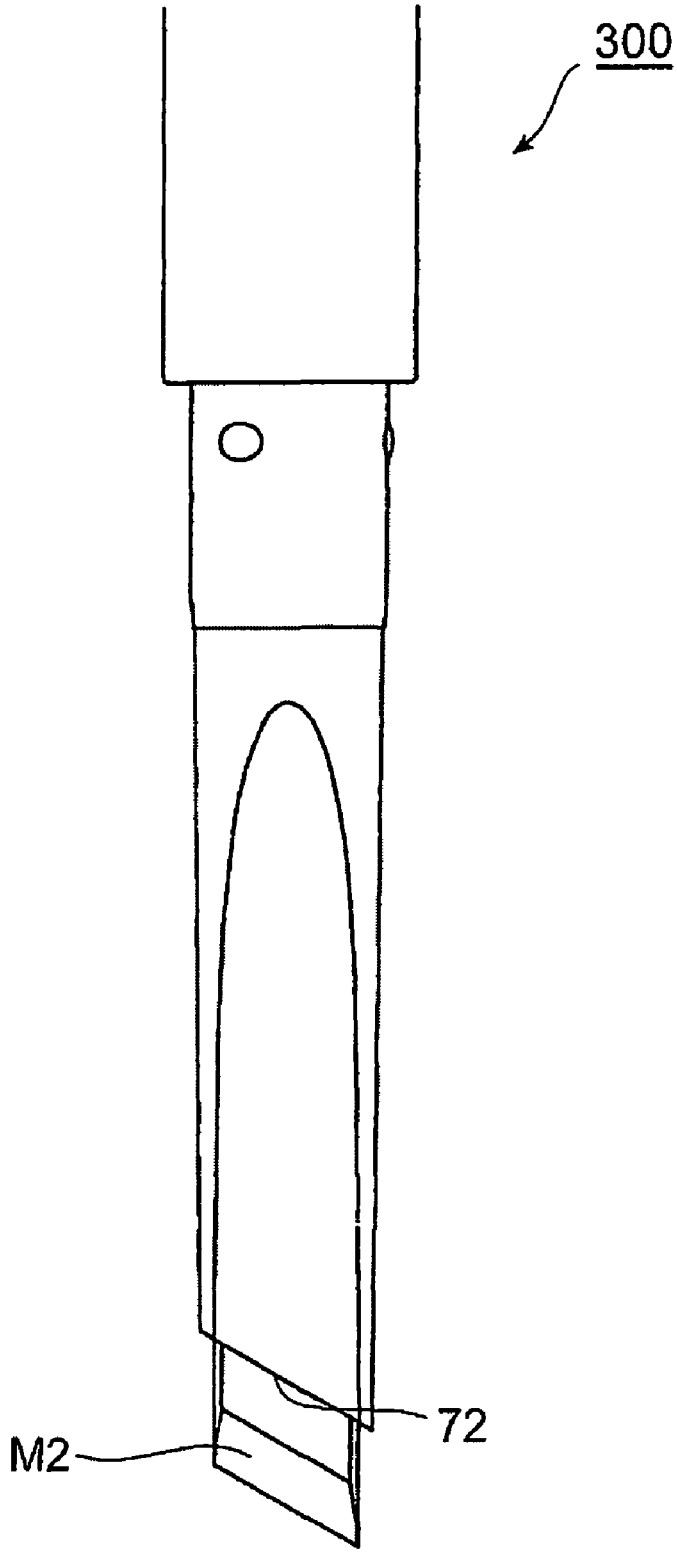
FIG. 19 is a side view of FIG. 18.

FIG. 18 is a perspective view showing a state of sharpening by using a stick-shaped cosmetic material feeding container 300 having a stick-shaped cosmetic material which has the same rectangular cross sectional shape as that of the stick-shaped cosmetic material M1 in FIG. 16 and provided with another leading end surface 72 which is different from FIG. 16, and using the sharpener 3 for the stick-shaped cosmetic material shown in FIGS. 11 and 12. FIG. 19 is a side view of FIG. 18.

The leading end surface 72 of the container 300 is formed as a slope surface which is sloped with respect to a plane orthogonal to an axis as seen from a vertical direction to the paper surface in FIG. 19. Further, the other structures of the container 300 are the same as those of the container 200 mentioned above.

If the same sharpening work into a double-edged shape as mentioned above is executed by using the stick-shaped cosmetic material and the container 300 structured as mentioned above, using the sharpener 3 for the stick-shaped cosmetic material, applying the slope surface 72 corresponding to the leading end surface of the container 300 to the bottom portions 3*ha* of the guide rails 3*h* and using the guide rails 3*h* as a guide, the leading end of the stick-shaped cosmetic material is formed as a slope shaped stick-shaped cosmetic material M2 copying from the slope surface 72 of the container 300, as shown in FIG. 19.

Figure 20:
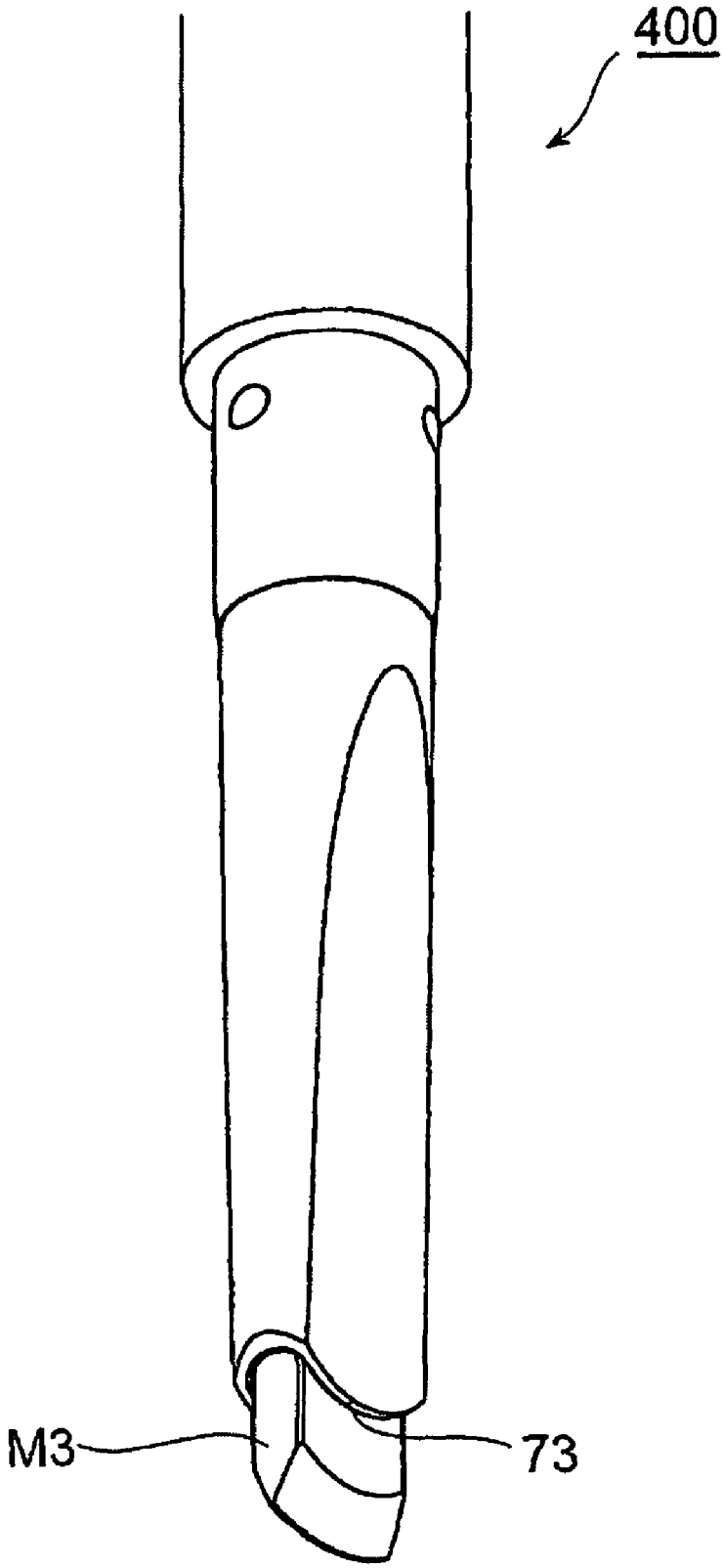
FIG. 20 is a perspective view showing a state after being sharpened by using a stick-shaped cosmetic material feeding container having a stick-shaped cosmetic material which has the same rectangular cross sectional shape as that of the stick-shaped cosmetic material in FIGS. 16 and 18 and provided with another leading end surface which is different from FIGS. 16 and 18, and using another sharpener for the stick-shaped cosmetic material which is different from the sharpener for the stick-shaped cosmetic material shown in FIGS. 11 and 12.
Figure 21:
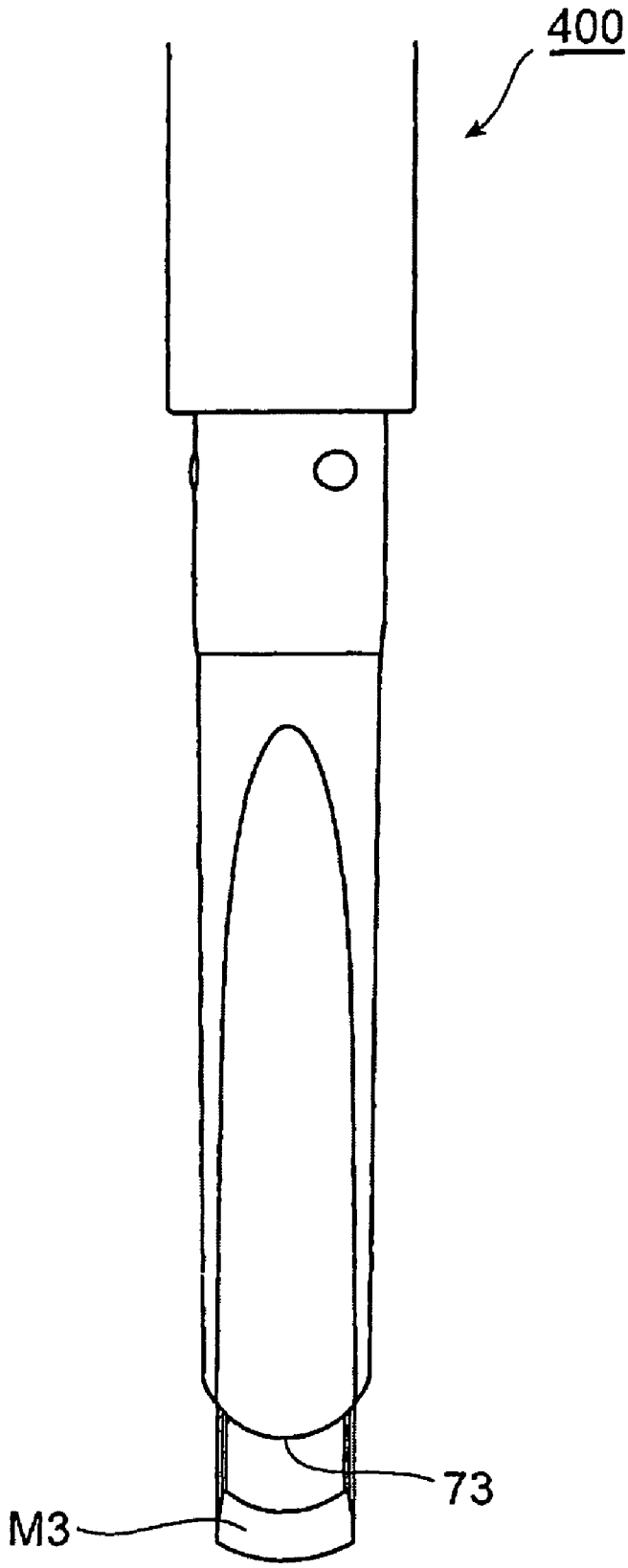
FIG. 21 is a side view of FIG. 20.

FIG. 20 is a perspective view showing a state of sharpening by using a stick-shaped cosmetic material feeding container 400 having a stick-shaped cosmetic material which has the same rectangular cross sectional shape as those of the stick-shaped cosmetic materials M1 and M2 in FIGS. 16 and 18 and provided with another leading end surface 73 which is different from FIGS. 16 and 18, and using another sharpener for the stick-shaped cosmetic material which is different from the sharpener 3 for the stick-shaped cosmetic material shown in FIGS. 11 and 12. FIG. 21 is a side view of FIG. 20.

The leading end surface 73 of the container 400 is formed in a circular arc surface as seen in a vertical direction to the paper surface in FIG. 21. Further, the other structures of the container 400 are the same as those of the containers 200 and 300 mentioned above.

Further, in this case, the sharpener for the stick-shaped cosmetic material is structured such that the sliding surface and the continuous surface thereof and the bottom surfaces of the guide rails are formed in a circular arc surface copying from the leading end surface 73 of the container 400.

If the same sharpening work into a double-edged shape as mentioned above is executed by using the stick-shaped cosmetic material, the container 400 and the sharpener for the stick-shaped cosmetic material structured as mentioned above, applying the circular arc surface 73 corresponding to the leading end surface of the container 400 to the circular arc surfaces at the bottoms of the guide rails and using the guide rails as a guide, the leading end of the stick-shaped cosmetic material is formed as that of a circular arc shaped stick-shaped cosmetic material M3 copying from the circular arc surface 72 of the container 400, as shown in FIG. 21.

The description is specifically given above of the present invention on the basis of the embodiments, however, the present invention is not limited to the embodiments mentioned above. For example, in the embodiments mentioned above, the stick-shaped cosmetic material cartridge 1 is structured detachably, however, may be structured non-detachably. Further, the present invention can be applied to the other types of stick-shaped cosmetic material feeding container than the cartridge type.

Further, the stick-shaped cosmetic material is not limited to the structure mentioned above, but can be structured as a stick-shaped cosmetic material having an oval cross sectional shape, or the like.

Further, in the embodiment mentioned above, the male thread and the female thread may be replaced with those which have the same function as a screw thread such as an intermittently arranged projection group or a spirally or intermittently arranged projection group, and the engagement projection may be replaced by a continuous screw thread.

Further, in the embodiment mentioned above, the stick-shaped cosmetic material sharpener 3 is structured such that the sliding surface 3*d* and the continuous surface 3*h* are formed in the V-shape in the view in the longitudinal direction, so as to sharpen the leading end portions of the stick-shaped cosmetic materials M to M3 in the double-edged shape, however, may be structured, for example, such that the sliding surface 3*d* and the continuous surface 3*g* are formed approximately in a check-mark shape (✓ shape) in the view in the longitudinal direction, so as to sharpen the leading end portions of the stick-shaped cosmetic materials M to M3 into single edged shape having approximately check-mark shape. In short, it is preferable that the sliding surface 3*d* and the continuous surface 3*g* are formed in an acute angle shape having an acute inner angle in the view in the longitudinal direction, so as to sharpen the leading end portions of the stick-shaped cosmetic materials M to M3 in the acute angle shape.

What is claimed is:

1. The stick-shaped cosmetic material feeding container, comprising:

a stick-shaped cosmetic material cartridge (1) for supporting a stick-shaped cosmetic material (M);

a cartridge accommodating container (2) for accommodating said cartridge (1);

a support body (7) provided in said cartridge accommodating container (2) for supporting said cartridge (1); and a stick-shaped cosmetic material sharpener (3) provided in said cartridge accommodating container (2) and detachably coupled to an end of said container (2), wherein the stick-shaped cosmetic material sharpener (3) includes a sliding portion (3*a*) adapted to receive a leading end portion of said stick-shaped cosmetic material (M), and the sliding portion (3*a*) has a sliding surface (3*d*) with an acute angle shape in cross section extending in a longitudinal direction of the sliding portion (3*a*) so as to allow the stick-shaped cosmetic material to slide in a longitudinal direction of the sliding surface (3*d*), wherein the sliding portion (3*a*) includes:

a blade (3*b*) having a cutting edge (3*e*) and a continuous surface (3*g*) extending in a longitudinal direction, said cutting edge (3*e*) being directed to an end side of the sliding portion (3*a*) at an intermediate position on the sliding portion (3*a*) in the longitudinal direction and being protruded slightly from the sliding surface (3*d*); and guide rails (3*h*) extending in the longitudinal direction above the sliding surface (3*d*) and said continuous surface (3*g*) for guiding a leading end surface (70) of the stick-shaped cosmetic material feeding container (100).

2. The stick-shaped cosmetic material feeding container (100) according to claim 1, wherein the guide rails (3*h*) are disposed above the sliding surface (3*d*) and the continuous surface (3*g*) and are provided with a pair of bottom portions (3*ha*) extending horizontally in the longitudinal direction for restraining the leading end surface (70) from shaking in a vertical direction when the container (100) is sliding and with a pair of side portions (3*hb*) extending vertically in the longitudinal direction for restraining the leading end surface (70) from shaking in a horizontal direction when the container (100) is sliding.

* * * * *